US007591661B2

(12) United States Patent
Suzuki et al.

(10) Patent No.: US 7,591,661 B2
(45) Date of Patent: Sep. 22, 2009

(54) CONNECTOR

(75) Inventors: Masayuki Suzuki, Tokyo (JP); Issey Miyake, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/088,850

(22) PCT Filed: Apr. 24, 2006

(86) PCT No.: PCT/JP2006/308569

§ 371 (c)(1),
(2), (4) Date: Jun. 18, 2008

(87) PCT Pub. No.: WO2006/088210

PCT Pub. Date: Aug. 24, 2006

(65) Prior Publication Data

US 2009/0163065 A1 Jun. 25, 2009

(30) Foreign Application Priority Data

Oct. 6, 2005 (JP) ..... 2005-294063
Oct. 24, 2005 (JP) ..... 2005-308619

(51) Int. Cl.
*H01R 13/15* (2006.01)

(52) U.S. Cl. ..... 439/260

(58) Field of Classification Search ..... 439/312, 439/492, 260, 261, 67, 79, 357, 267, 493–499, 439/358, 329

See application file for complete search history.

(56) References Cited

U.S. PATENT DOCUMENTS 6,726,497 B2 * 4/2004 Nogawa et al. ..... 439/260
7,044,773 B2 * 5/2006 Suzuki et al. ..... 439/495
7,083,454 B2 * 8/2006 Suzuki ..... 439/260
7,361,048 B2 * 4/2008 Shimada ..... 439/492

FOREIGN PATENT DOCUMENTS

| | | | |
|---|---|---|---|
| JP | 11-307198 | A | 11/1999 |
| JP | 2000-106238 | A | 4/2000 |
| JP | 2002-270290 | A | 9/2002 |
| JP | 2004-71160 | A | 3/2004 |
| JP | 2004-233197 | A | 8/2004 |
| JP | 2005-150527 | A | 6/2005 |
| JP | 2005-294063 | A | 10/2005 |
| JP | 2006-228446 | A | 8/2006 |

* cited by examiner

*Primary Examiner*—Edwin A. Leon
(74) *Attorney, Agent, or Firm*—Sughrue Mion, PLLC; Pavel I. Pogodin

(57) ABSTRACT

The invention provides a connector enabling a dead space of a substrate to be reduced while maintaining connection strength. For this purpose, H-shaped contacts comprise holding means permitting pushing portions of a pivoting member to be pivoted between pressure receiving portions and connection portions of the contacts. When an actuating portion of the pivoting member is moved toward a fitting opening of a housing, the pushing portions are pivotally moved and their axes of rotation are moved to achieve their compact rotation, thereby bringing contact portions of the contacts into contact with a connecting object. The substrate is formed with a notch into which the connector is fitted to be connected to the substrate. Fixtures are provided at both longitudinal ands of the connector and both or either of the fixtures is provided with an extending piece integral therewith or separate therefrom, extending substantially perpendicularly to the substrate, thereby limiting a rotated angle of the pivoting member upon it being opened.

18 Claims, 16 Drawing Sheets

CONNECTOR

BACKGROUND OF THE INVENTION

This invention relates to a connector for use in electric and electronic appliances such as mobile appliances and the like, and more particularly to a connector which achieves stable electrical connection with a connecting object such as a flexible printed circuit board or flexible flat cable, a reduced overall height of the connector, and minimization of a dead space of a substrate, and enables the connector to be mounted onto a side of the substrate.

Connectors for use in mobile phones, CCD cameras (charge coupled device cameras) and the like are very thin in overall height and have extremely narrow pitches (so-called lighter and more compact). Such connectors each mainly comprise a housing, contacts and a slider to embrace a flexible printed circuit board or flexible flat cable between the housing and the slider. Various methods may be considered for holding a flexible printed circuit board or flat cable by the housing and the slider. Among them, there are many constructions that after a flexible printed circuit board or flat cable has been inserted into a housing, a slider is inserted into the housing to push the circuit board or cable against the contacts.

In recent years, moreover, connectors using a pivoting member instead of the slider are increasingly being used to bring contacts into contact with a connecting object such as a flexible printed circuit board. In one type of these connectors, a pivoting member is pivotally moved on the side of insertion of a connecting object (front pivoting type), and in the other type, a pivoting member is pivotally moved on the opposite side from the insertion of a connecting object (rear pivoting type).

Other than these constructions of connectors, there are connectors of constructions using a pivoting member to bring contacts into contact with a connecting object such as a flexible printed circuit board as disclosed in the following Patent Literatures 1 to 7.

The Patent Literature 1 discloses a connector of a front pivoting type, and the Patent Literatures 2, 3 and 4 disclose connectors of rear pivoting types. Moreover, the applicant of the present application has proposed connectors of rear pivoting types disclosed in the Patent Literatures 5, 6 and 7.

Patent Literature 1; Japanese Patent Application Opened No. 2000-106,238

Patent Literature 2; Japanese Patent Application Opened No. 2002-270,290

Patent Literature 3; Japanese Patent Application Opened No. H11-307,198 (1999)

Patent Literature 4; Japanese Patent Application Opened No. 2004-71,160

Patent Literature 5; Japanese Patent Application Opened No. 2004-233,197

Patent Literature 6; Japanese Patent Application No. 2005-37,330

Patent Literature 7; Japanese Patent Application No. 2005-150,527

Patent Literature 8; Japanese Patent Application No. 2005-294,063

According to the abstract of the Patent Literature 1, the Japanese Patent Application Opened No. 2000-106,238, this invention has an object to provide a connector for a cable, which requires only a slight operating force even if there are many conductors of the cable. Disclosed in the Patent Literature 1 is a connector for a cable comprising contacts each having a contact portion facing to one surface of a cable and a pivot portion facing to the other surface of the cable, and an actuating element adapted to push the cable against the contact portions of the contacts and having cam portions positioned between the pivot portions and the cable and holes into which the pivot portions are inserted with clearances, the pivot portions each having a recess corresponding to the cam portion so that the actuating element is adapted to engage the pivot portions in a manner that the actuating element is pivotally movable about the cam portions.

By the way, claim 1 of the Patent Literature 1 recites that in a connector for a cable including contacts each having a contact portion facing to one surface of said cable and a pivot portion facing to the opposite surface of the cable, an insulator for holding said contacts, and an actuating element for pushing the cable against the contact portions of said contacts, said actuating element includes cam portions positioned between the pivot portions and the cable and holes into which said pivot portions are inserted with clearances, respectively, and said pivot portions each having a recess corresponding to said cam portion so that said actuating element is adapted to engage the pivot portions in a manner that the actuating element is pivotally movable about the cam portions. Claim 2 recites the connector for a cable having a construction that said insulator includes anchoring portions adapted to engage said actuating element to hold said actuating element under the condition that said cam portions are spaced apart from said contact portions of the contacts when the cable has not been connected to the connector. Claim 3 recites the connector for a cable having a construction that said cable is a flat cable, and said insulator includes cable anchoring grooves for receiving side edges of the flat plate-shaped cable to prevent the cable from moving in the direction of its thickness when the cable has been connected to the connector. Claim 4 recites that in a connector obtaining electrical connection between contacts and a cable in a manner that one surface of the cable faces to the contact portions of the contacts and the opposite surface of the cable is pushed against the contact portions by the rotational actuating element, said contact portions each provided with at least two contact side projections, while said actuating element is provided with actuating element side projections corresponding to spaces between said contact side projections. Claim 5 recites the connector for a cable including said contacts each having a pivot portion facing to the opposite surface of the cable and said actuating element having cam portions between the pivot portions and the cable, said cam portions each provided with said actuating element side projection.

According to the abstract of the Patent Literature 2, the Japanese Patent Application Opened No. 2002-270,290, this invention has an object to provide a reduced overall height connector having an actuator which is actuated by a slight operating force and capable of enlarging moving distances of contacts to securely perform electrical connection. Disclosed is a connector comprising an actuator having cam portions and an actuating portion, between both the portions being formed with relief grooves into which tips of spring portions of the contacts are inserted and removed, so that when the actuator is rotated about its fulcrum through 90° in a clockwise direction, the cam portions cause the spring portions and connecting spring portions of the respective contacts to be elastically deformed to embrace a flexible printed circuit board between projections of the contact portions, with the result that patterns of the flexible printed circuit board are connected to a printed substrate through terminals of the contacts, and an insulator having a ceiling portion covering the contact portions of the respective contacts and formed in the lower portion of the front side of the ceiling portion with a guide portion for inserting the flexible printed circuit board into the connector.

By the way, claim 1 of the Patent Literature 2 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein said insulator includes a ceiling portion for covering at least ones of the contact portions from the fitting side and said ceiling portion is formed with a guide portion for guiding the insertion of said connecting object. Claim 2 recites the connector having said contacts whose at least ones of the contact portions are each provided with an inclined portion inclined toward said connecting object in the proximity of said jointing spring portion. Claim 3 recites the connector having said actuator comprising an actuating portion, cam portions for actuating said actuated portions of said contacts, and relief grooves between said actuating portion and said cam portions so that said actuated portions can be inserted into said relief grooves before the connector is connected to said connecting object. Claim 4 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein the contact portions of said first beams each include a first protrusion and a second protrusion arranged side by side in the inserting direction of said connecting object and extending toward said connecting object, and the contact portions of said second beams each include a third protrusion and a fourth protrusion arranged side by side in the inserting direction of said connecting object and extending toward said connecting object so that said third protrusion is positioned between said first protrusion and said second protrusion or said first protrusion is positioned between said third protrusion and said fourth protrusion with the result that said first and second protrusions or said third and fourth protrusions become the contacts contacting said connecting object.

According to the abstract of the Patent Literature 3, the Japanese Patent Application Opened No. H11-307,198 (1999), this invention has an object to improve operationality and holding power of a connector connecting a plurality of terminals and holding a flexible printed circuit board and the like. The disclosed connector for a printed circuit board includes a housing formed with inserting groove for inserting the flexible printed circuit board, a plurality of contacts provided side by side whose contact portions are arranged to extend and retract relative to the inserting groove, and an actuating member arranged pivotally movably between a connecting and a disconnecting position. The actuating member is provided with a plurality of cams so that when the actuating member is in the connecting position, contacts are urged with their actuated portions by the cams to extend their contact portions into the inserting groove thereby enabling the contact portions to be pushed against and connected to terminals of the flexible printed circuit board and holding the circuit board. On the other hand, when the actuating member is in the disconnecting position, some contacts are urged with their actuated portions by the cams to slightly extend their contact portions into the inserting groove so as to abut against the flexible printed circuit board or the like, thereby temporarily holding the circuit board, while the contact portions of the remaining contacts are retracted from the inserting groove.

By the way, claim 1 of the Patent Literature 3 recites that in a connector for a printed circuit board, provided with a plurality of contacts arranged side by side for connecting a plurality of terminals of a printed circuit board or the like in the lump, said connector comprises a housing having an inserting groove for inserting the printed circuit board or the like, said contacts arranged to extend and retract relative to said inserting groove, and an actuating member provided movably between a connecting and a disconnecting position, and when the actuating member is in the connecting position, the contacts are urged by the actuating member so as to extend into the inserting groove to push the terminals of the flexible printed circuit board or the like so that the contacts are connected to the terminals and hold the printed circuit board or the like, and when the actuating member is in the disconnecting position, some of the contacts extend slightly into the inserting groove to abut against and temporarily hold the printed circuit board or the like, and the remaining contacts retract relative to the inserting groove. Claim 2 recites a connector for a printed circuit board in that the plurality of the contacts are formed in the same shape and the actuating member is provided with a plurality of cams, and when the actuating member is in the connecting position, the contacts are urged by the cams to extend into the inserting groove, and when the actuating member is in the disconnecting position, the some contacts are urged by the cams to slightly extend into the inserting groove and the remaining contacts are retracted relative to the inserting groove.

According to the abstract of the Patent Literature 4, the Japanese Patent Application Opened No. 2004-71,160, this invention has an object to provide a connector capable of securely pushing a flexible printed circuit board or flexible flat cable to contact portions of contacts by means of a slider without degrading strength of respective members and specifications or customers demands, and achieving a superior operationality, narrower pitches of conductors and reduced overall height. This connector comprises contacts each comprising a contact portion, a connection portion, and an elastic portion and a fulcrum portion between the contact portion and the connection portion, and a pressure receiving portion extending from the elastic portion in a position facing to the connection portion, and the contact portion, elastic portion, fulcrum portion and connection portion being arranged in the form of a crank, and a slider comprising pushing portions arranged continuously in the longitudinal direction and the slider being pivotally mounted on a housing so that the pushing portions are pivotally moved in a space between the connection portions and pressure receiving portions of the contacts.

By the way, claim 1 of the Patent Literature 4 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the contact portion, elastic portion, fulcrum portion and connection portion being arranged substantially in the form of a crank, and the slider is provided with pushing portions continuously arranged in its longitudinal direction and is mounted on the housing so that the pushing portions are pivotally moved in a space between the connection portions and pressure receiving portions of the contacts. Claim 2 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with pushing portions arranged continuously in its longitudinal direction and mounted on the housing so that the pushing portions are pivotally moved in a space between the connection portions and the pressure receiving portions of the contacts of the one kind and between the pressure receiving portions of the contacts of the other kind and the housing. Claim 3 recites that when the pushing portions of the slider are pivotally moved in the space between the connection portions and the pressure receiving portions of the contacts of the one kind, the pressure receiving portions are raised by the pushing portions so that the elastic portions are tilted about the fulcrum portions toward the contact portions to push the contact portions against the flexible printed circuit board or flexible flat cable. Claim 4 recites that the pressure receiving portions of the contacts of the one kind or the other kind are each provided with a projection so that the pushing portions of the slider are prevented from moving toward the connection portions of the contacts of the one kind. Claim 5 recites that the pushing portions of the slider are of an elongated shape. Claim 6 recites that the slider is formed with a required number of anchoring holes independent from one another, which are adapted to engage the projections of the contacts, respectively. Claim 7 recites the elongated pushing portions being in the form of an ellipsoid. Claim 8 recites a connector having contacts of the one kind each provided with a further contact portion at a location extending from the fulcrum portion and adapted to contact the flexible printed circuit board or flexible flat cable. Claim 9 recites that a connector having contacts of the other kind each provided with an extension portion extending from the fulcrum in the opposite direction of the connection portion, and having the slider mounted on the housing so that the pushing portions of the slider are pivotally moved in the space between the extension portions and the pressure receiving portions. Claim 10 recites a connector having the contacts of the other kind each further provided between the fulcrum portion and the connection portion with a contact portion adapted to contact the flexible printed circuit board or flexible flat cable.

According to the abstract of the Patent Literature 5, the Japanese Patent Application Opened No. 2004-233,197, this invention has an object to provide a connector which achieves a miniaturization or reduced overall height, and a stable electrical connection with simple operation and slight operating force without any failed connection even if a connecting object is subjected to undue external force. Disclosed is the connector comprising contacts each including a first piece having a contact portion at one end adapted to contact the connecting object, a pressure receiving portion at the other end to be urged by the pivoting member, and a projection inwardly extending from the tip of the pressure receiving portion, a second piece having at one end a connection portion to be connected to a substrate and at the other end a fulcrum portion, and an elastic portion for connecting the first piece and the fulcrum portion, and the contact portion, elastic portion, fulcrum portion and connection portion being arranged substantially in the form of a crank; a housing formed with protection walls at least at both the ends for preventing its ceiling portion from being raised when the connecting object is subjected to accidental external force upward; and a pivoting member including a actuating portion, urging portions, projections and anchoring holes so that when the urging portions are pivotally moved, the axis of rotation is moved with the pivotal movement to achieve their compact rotation. By the way, claim 1 of the Patent Literature 5 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts each comprise a first piece having the contact portion at one end adapted to contact said connecting object, a pressure receiving portion at the other end adapted to be urged by said pivoting member, and a projection inwardly extending from the tip of said pressure receiving portion; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts, and the rotational axis of said urging portions is moved with their pivotal movement to achieve their compact rotation. Claim 2 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts consist of two kinds of contacts arranged alternately staggered, said contacts of the one kind each comprising a first piece having the contact portion at one end adapted to contact said connecting object and a pressure receiving portion at the other end adapted to be urged by said pivoting member; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, and said contacts of the other kind each comprising a first piece having the contact portion at one end adapted to contact said connecting object and a pressure receiving portion at the other end adapted to be urged by said pivoting member; a second piece having a connection portion at one end adapted to be connected to a board and a fulcrum portion at the other end; and an elastic portion for connecting said first piece and said fulcrum portion; and said contact portion, said elastic portion, said fulcrum portion and said connection portion being arranged substantially in the form of a U-shape, and said pressure receiving portions of the contacts of at least either the one kind or the other kind being each provided at the tip with an inwardly extending projection, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts of the one kind and between the pressure receiving portions of the contacts of the other kind and the housing, and the rotational axis of said urging portions is moved with their pivotal movement to achieve their compact rotation. Claim 3 recites in the connector claimed in claim 1 or 2 that when the connecting object is connected to the connector, the urging portions of the pivoting member are positioned such that before connecting said connecting object to said connector, the lower ends of said urging portions are positioned between the projections of said pressure receiving portions and the connection portions and the housing or extension portions, that second on pivotally moving said actuating portion of the pivoting member, said urging portions are moved in a direction opposite to said fitting opening so that the lower ends of said urging portions are embraced between the projections of said pressure receiving portions and the connection portions and the housing or extension portions, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions and the housing or the extension portions, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections. Claim 4 recites in the connector claimed in claim 1, 2 or 3 that said ceiling portion is further provided with a protection wall substantially at its center for preventing said ceiling portion from being raised when the connecting object is accidentally subjected to undue external force upward. Claim 5 recites in the connector claimed in claim 1 or 2 that said contacts and said contacts of the one kind are each provided with an extension portion extending from the fulcrum portion in such a direction that said extension portion faces to said contact portion. Claim 6 recites in the connector claimed in claim 2 that said contacts of the other kind are each provided with an extension portion extending from the fulcrum portion in such a direction that said extension portion faces to said pressure receiving portion, and said pivoting member is mounted on the housing so that said urging portions of the pivoting member are pivotally moved between said extension portions and said pressure receiving portions. Claim 7 recites in the connector claimed in claim 2, 4 or 5 that a further contact portion adapted to contact the connecting object is provided on said extension portion of each of said contacts and said contacts of the one kind, and a further contact portion adapted to contact the connecting object is also provided between said fulcrum portion and the connection portion of each of said contacts of the other kind. Claim 8 recites in the connector claimed in claim 2 or 3 that said housing is provided with recessed portions on the side of the fitting opening for conducting a connecting object, and the contacts of the other kind are so arranged that the connection portions of the contacts do not extend from said recessed portions. Claim 9 recites in the connector claimed in any one of claims 1 to 8 that the connecting object is provided with anchoring portions, and there are provided locking members each having an engaging portion adapted to engage said anchoring portion and said locking means are substantially the same in construction as that of said contacts, said contacts of the one kind or said contacts of the other kind. Claim 10 recites in the connector claimed in claim 7 that said further contact portion provided on said extension portion of each of said contacts and said contacts of the one kind is constructed to have elasticity, and said further contact portion provided between the fulcrum portion and the connection portion of each of said contacts of the other kind is constructed to have elasticity. Claim 11 recites in the connector claimed in claim 9 or 10 that the housing is provided with anchoring portions at locations corresponding to the connection portions of said contacts or said contacts of the one kind, while the connection portions of said contacts and said contacts of the one kind are each provided with an inclined engaging portion adapted to engage said anchoring portion, and said extension portions of said contacts and said contacts of the one kind are not held by the housing. Claim 12 recites in the connector claimed in claim 11 that when inserting said contact or said contact of the one kind into said housing from the opposite side of said fitting opening, at the commencement of the engagement of the anchoring portion with the engaging portion, the contact portion of the contact is substantially in parallel with an inserting hole of the housing, and on proceeding of the insertion the contact is obliquely inclined so that the contact portion of the contact comes into contact with the upper wall of the inserting hole, and that when the insertion of the contact has been completed, the contact portion has returned in parallel with the inserting hole with the aid of said inclined engaging portion.

According to the abstract of the Patent Literature 6, the Japanese Patent Application No. 2005-37,330, this invention has an object to provide a connector mounted on one side of the substrate to achieve more reduced overall height and superior operationality of the pivoting member. The connector includes substantially H-shaped contacts; fixtures fixing the connector to a substrate on longitudinal ends; a housing having a ceiling portion covering contact portions of the contacts, a protection wall at the end of the ceiling portion on the fitting opening side for preventing raising of the ceiling portion on being accidentally forced upward, extension walls at the longitudinal ends for holding the fixtures, and slits each between the extension wall and a bearing for a pivoting member; and the pivoting member having an actuating portion, urging portions, and anchoring holes and mounted on the housing such that between the connection portions and the pressure receiving portions of the contacts the urging portions perform a compact pivotal movement with rotation axis moving. The substrate is provided with a notch and the connector is connected to said substrate in a manner that said connector is fitted in said notch of the substrate.

By the way, claim 1 of the Patent Literature 6 recites a connector to be mounted to a side surface of a substrate, including a plurality of contacts each having at least one contact portion adapted to contact a connecting object, a housing for arranging and holding said contacts and having a fitting opening into which said connecting object is inserted, and a pivoting member causing said contacts to be elastically deformed and pressed against said connecting object, wherein said connector comprises said contacts each including a first peace having the contact portion at one end adapted to contact said connecting object, a pressure receiving portion at the other end adapted to be pressed by said pivoting member, and a projection inwardly extending from the tip of said pressure receiving portion; a second piece having a further contact portion at one end, a connection portion at the other end to be connected to the substrate, and a fulcrum portion between said further contact portion and said connection portion; and an elastic portion for connecting said first piece and said fulcrum portion, said contact portion, said elastic portion, said fulcrum portion and said connection portion being arranged in the form of a crank, fixtures at longitudinal ends of the connector for fixing said connector to said substrate, said housing including a ceiling portion for covering said contact portions of said contacts, said ceiling portion being formed with a protection wall at the end of said ceiling portion on the side of said fitting opening for preventing said ceiling portion from being raised when the connecting object is accidentally subjected to an undue external force upward, and said housing further including extension walls at its longitudinal ends for holding said fixtures, and slits each between said extension wall and a bearing for said pivoting member, and said pivoting member including an actuating portion for pivotally moving said pivoting member, urging portions continuously arranged in the longitudinal direction of said pivoting member, and anchoring holes independent from one another for receiving therein said pressure receiving portions and adapted to engage said projections, respectively, said pivoting member being mounted on said housing so that urging portions are pivotally moved between said connection portions and said pressure receiving portions of said contacts, and the rotation axis of said urging portions is moved with their pivotal movement to achieve their compact rotation, and wherein said substrate is provided with a notch, and said connector is connected onto said substrate in a manner that said connector is fitted in said notch of the substrate. Claim 2 recites in the connector claimed in claim 1 that the connector is connected onto the substrate such that said substrate is positioned on the side of the upper surfaces of the connection portions of said contacts, and said pivoting member is operated on the opposite side of the connection portions of said contacts with respect to said substrate. Claim 3 recites in the connector claimed in claim 1 or 2 that when the connecting object is connected to the connector, the urging portions of said pivoting member are positioned such that before connecting said connecting object to said connector, the lower ends of said urging portions are positioned between the projections of said pressure receiving portions and said connection portions of said contacts, that second on pivotally moving said actuating portion of the pivoting member, said urging portions are moved in a direction opposite to said fitting opening so that the lower ends of said urging portions are embraced between the projections of said pressure receiving portions and said connection portions of said contacts, that third on further pivotally moving said actuating portion of the pivoting member, said urging portions at their second position are pivotally moved about the center of said urging portions as their rotation axis, that fourth on further pivotally moving said actuating portion of the pivoting member, said urging portions at their third position are pivotally moved about the center of said urging portions as their rotation axis so that said urging portions stand substantially upright between said pressure receiving portions and said connection portions, and the rotation axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections.

According to the abstract of the Patent Literature 7, the Japanese Patent Application No. 2005-150,527, the invention has an object to provide a connector which achieves a reduced overall height of the order of 1.0 mm and space-saving substrate (in the inserting direction of a circuit board) and which obtains stable connection with a slight operating force and does not cause any defective connection even if a connecting object is accidentally subjected to an external force. The object is accomplished by a connector comprising substantially H-shaped contacts each including a first piece having a contact portion and a pressure receiving portion, a second piece having a contact portion and a connection portion, and a jointing portion for connecting these first and second pieces, and further including holding means for permitting pushing portions of a pivoting member to pivotally move between the pressure receiving portions and the connection portions, a housing having a ceiling portion formed at least at both ends with protection walls for preventing the ceiling portion from being upwardly deformed when the connecting object is accidentally forced upwardly, and the pivoting member including the pushing portions, anchoring holes independently from one another and an actuating portion which is pivotally moved toward a fitting opening of the housing to bring the contact portions of the contacts into contact with the connecting object.

By the way, claim 1 of the Patent Literature 7 recites a connector including a plurality of contacts each having at least one contact portion adapted to contact a connecting object, a housing arranging and holding said contacts therein and having a fitting opening into which said connecting object is inserted, and a pivoting member causing said contacts to be elastically deformed to push the contacts against said connecting object, wherein said contacts each comprise a first piece having on the side of one end the contact portion adapted to contact said connecting object and on the side of the other end a pressure receiving portion adapted to be pushed by said pivoting member, a second piece having on the side of one end the further contact portion adapted to contact said connecting object and on the side of the other end a connection portion adapted to be connected to a substrate, and a jointing portion for connecting said first and second pieces, and the contact portion of said first peace, said jointing portion, and said connection portion being arranged substantially in the form of a crank, and said contacts further comprise holding means permitting pushing portions of said pivoting member to pivotally move between said pressure receiving portions and said connection portions, wherein said housing comprises a ceiling portion for covering the contact portions of said contacts, and said ceiling portion is provided with protection walls at least at both ends of said ceiling portion for preventing said ceiling portion from being raised when said connecting object is accidentally forced upwardly, and wherein said pivoting member comprises an actuating portion for pivotally moving the pivoting member, the pushing portions continuously arranged in the longitudinal direction of said pivoting member, and anchoring holes independent from one another for receiving therein said pressure receiving portions, respectively, said pivoting member being mounted on said housing so that said pushing portions are pivotally moved between said connection portions and said pressure receiving portions of said contacts, during which pivotal movement, the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object. Claim 2 recites in the connector claimed in claim 1 that said holding means comprises a projection provided on said pressure receiving portion of said first piece of at least every other contact to extend toward said connection portion, and a protrusion provided in the proximity of tip of the connection portion of said second piece of said at least every other contact to extend toward said pressure receiving portion. Claim 3 recites in the connector claimed in claim 1 that said holding means comprises a raised portion provided between the connection portion of said second piece and said jointing portion of at least every other contact to extend toward said pressure receiving portion. Claim 4 recites in the connector claimed in the claim 2 or 3 that the contacts each provided with said projection and said projection and the contacts each provided with said raised portion are arranged to be alternately staggered. Claim 5 recites in the connector claimed in claim 2, 3 or 4 that the pressure receiving portion of said first piece is provided at its tip with an extended portion. Claim 6 recites in the connector claimed in claim 1 that said protection wall is formed at the center of said ceiling portion or over all said ceiling portion. Claim 7 recites in the connector claimed in any one of claims 1 to 6 that when said connecting object is connected to said connector, the pushing portions of said pivoting member are successively positioned such that before connecting said connecting object to said connector, the lower ends of the pushing portions of said pivoting member are in contact with said raised portions, that, second, when said actuating portion is pivotally moved, the pushing portions are pivotally moved about centers of curvatures of the lower ends of the pushing portions as axes of rotation, respectively, under the condition of the lower ends in contact with said raised portions so that said pushing portions assume slightly inclined positions, that, third, when said actuating portion is further pivotally moved, the pushing portions are pivotally moved about centers of said pushing portions as axes of rotation, respectively, while the lower ends of said pushing portions are somewhat moved from the second condition toward said connection portions so that said pushing portions assume substantially vertical positions, that, fourth, when said actuating portion is further pivotally moved, said lower ends of the pushing portions are further moved from the third condition toward said connection portions and upper ends of said pushing portions are moved toward said projections so that said pushing portions assume vertical positions, that, fifth, when said actuating portion is further pivotally moved, said lower ends are further moved from the fourth condition toward said connection portions and the upper ends of said pushing portions come into contact with said projections, and that, finally, when the actuating portion of the pivoting member is further pivotally moved from the fifth condition, said pushing portions are pivotally moved about centers of curvatures of said upper ends as axes of rotation, respectively, whereby the contact portions of said contacts are brought into contact with said connecting object by pivotally moving said pivoting member toward the fitting opening of said housing.

According to the abstract of the Patent Literature 8, the Japanese Patent Application No. 2005-294,063, this invention has an object to provide a connector enabling a dead space (in a depth direction) of a substrate to be reduced and a reduced overall height of the connector to be maintained, and eliminating any defective or failed connection, any damage to parts and the like. Holding means are provided for permitting pushing portions 48 of a pivoting member 16 to be pivotally moved between pressure receiving portions 34 and connection portions 36 of substantially H-shaped contacts 14. A housing 12 is formed with slits 21 at locations corresponding to the contacts on the side of the housing contacting the pivoting member 16. When an actuating portion 46 of the pivoting member 16 is pivotally moved toward a fitting opening 18 of the housing 12, pushing portions 48 of the pivoting member 16 are pivotally moved between the connection portions 36 and the pressure receiving portions 34 of the contacts 14 so that contact portions 32 of the contacts 14 are brought into contact with a connecting object. A substrate 80 is formed with a notch 82, and the connector 10 is connected to the substrate in a manner that the connector is fitted in the notch 82. Fixtures are arranged at both longitudinal ends of the housing for fixing the connector to the substrate. Extending pieces 60 provided on the fixtures 17 serve to limit a rotated angle of the pivoting member 16 when it is opened.

With all the connectors disclosed in the Patent Literatures 1 to 5, the pivoting member is pivotally moved on the side of the fitting opening or its opposite side to bring the contacts into contact with a connecting object, and the connector is mounted on the upper or lower surface of a substrate. There are many cases that the connectors are mounted onto the side of a substrate depending on customer's specifications or due to mounting spaces of substrates even in the connectors disclosed in the Patent Literatures 1 to 5. In the case that parts are arranged only on one surface of a substrate according to a customer's specification, however, with the connectors disclosed in the Patent Literatures 1 to 5 a reduced overall height of the connector less than 0.9 mm (a height of mounted connector) would become impossible, and the operation of a pivoting member would become difficult. Therefore, the applicant of the present application has proposed a connector of a construction disclosed in the Patent Literature 6. With the connector of the construction disclosed in the Patent Literature 6, however, as the pivoting member is moved or pivotally moved onto the opposite side from the fitting opening because of the rear locking type, the notch of the substrate would become larger (particularly in the depth direction) to increase a dead space of the substrate. These problems have remained to be solved.

Accordingly, the connectors having the pivoting member adapted to be operated on the side of the fitting opening as in the Patent Literature 1 have been attempted to use by the applicant of the present case, but with the construction of the Patent Literature 1, it is impossible to provide contacts to arrange above and below. Therefore, the applicant has used and proposed the construction disclosed in the Patent Literature 7. With the construction disclosed in the Patent Literature 7, however, the height of the connector increases by the thickness of the pivoting member, making difficult to maintain 0.9 mm of the height of the mounted connector, and upon rotation of the pivoting member, it is likely to collide with the substrate due to a smaller dimension in the depth direction to lead damages of the pivoting member and the substrate. Moreover, when a connecting object such as a flexible printed circuit board is accidentally forced upwardly, the holding force of the pivoting member becomes weak because the direction of the accidental force coincides with the direction of rotation of the pivoting member so that the pivoting member is likely to be dislodged, resulting in a defective or failed connection. Consequently, the applicant has proposed the construction as disclosed in the Patent Literature 8 in order to solve these problems. Even with the construction disclosed in the Patent Literature 8, however, it is difficult to eliminate the dead space of the connector in its longitudinal direction, while maintaining the connection strength of a connector.

SUMMARY OF THE INVENTION

In view of the problems of the prior art described above, it is an object of the invention to provide a connector which reduces a dead space (in a depth direction and a longitudinal direction) of a substrate and maintains a required connection strength of the connector, while eliminating any defective or failed connection and any damage of parts.

In order to accomplish the above object, the first invention lies in a connector to be mounted on a side of a substrate, including a plurality of contacts 14 each having two contact portions 32*a* and 32*b* adapted to contact a connecting object, a housing 12 arranging and holding said contacts 14 and having at a front section a fitting opening 18 into which said connecting object is inserted, and a pivoting member 16 causing said contacts 14 to be elastically deformed so that said contacts 14 are pushed against said connecting object, wherein said contacts 14 each comprise a first piece 28 having at one end the contact portion 32*a* adapted to contact said connecting object and at the other end a pressure receiving portion 34 adapted to be pushed by said pivoting member 16; a second piece 30 having at one end a further contact portion 32*b* adapted to contact said connecting object and at the other end a connection portion 36 to be connected to a substrate; and a jointing portion 38 for connecting said first and second pieces 28 and 30; and the contact portion 32*a* of said first piece 28, said jointing portion 38, and said connection portion 36 being arranged substantially in the form of a crank, and said contacts 14 further comprise holding means for permitting pivotal movement of pushing portions 48 of said pivoting member 16 between said pressure receiving portions 34 and said connection portions 36, wherein said housing 12 comprises a ceiling portion 20 for covering the contact portions 32*a* and 32*b* of said contacts 14; wherein said pivoting member 16 comprises an actuating portion 46 for pivotally moving the pivoting member 16; the pushing portions 48 continuously arranged in the longitudinal direction of said pivoting member 16; and anchoring holes 50 independent from one another for receiving therein said pressure receiving portions 34, respectively; said pivoting member 16 being mounted on said housing 12 so that said pushing portions 48 are pivotally moved between said connection portions 36 and said pressure receiving portions 34 of said contacts 14, during which pivotal movement, the axis 54 of rotation of said pushing portions 48 is moved with their pivotal movement to achieve their compact rotation, and said actuating portion 46 of the pivoting member 16 is pivotally moved toward the fitting opening 18 of said housing 12 to bring the contact portions 32*a* and 32*b* of said contacts 14 into contact with said connecting object, and wherein said substrate 80 is provided with a notch 82 and said connector 10 is connected to said substrate 80 in a manner that said connector 10 is fitted in said notch 82, and fixtures 17 for fixing said housing to said substrate 80 are arranged at both longitudinal ends of said housing 12, and both or either of said fixtures 17 is provided with an extending piece 60 integral with or separate from said fixture 17 and extending substantially perpendicularly to said substrate 80 on the side of the connection portions 36 of said contacts 14 so that a rotated angle of said pivoting member 16 is limited by said extending piece 60 when pivoting member 16 is opened.

The second invention lies in a connector to be mounted on a side of a substrate, including a plurality of contacts 142 each having two contact portions 322*a* and 322*b* adapted to contact a connecting object, a housing 122 arranging and holding said contacts 142 and having at an upper section a fitting opening 182 into which said connecting object is inserted, and a pivoting member 162 causing said contacts 142 to be elastically deformed so that said contacts 142 are pushed against said connecting object, wherein said contacts 142 each comprise a first piece 282 having at one end the contact portion 322*a* adapted to contact said connecting object and at the other end a pressure receiving portion 342 adapted to be pushed by said pivoting member 162; a second piece 302 having at one end a further contact portion 322*b* adapted to contact said connecting object and at the other end a connection portion 362 to be connected to a substrate; and a jointing portion 382 for connecting said first and second pieces 282 and 302; and said contacts 142 further comprise holding means for permitting pivotal movement of pushing portions 482 of said pivoting member 162 between said pressure receiving portions 342 and said connection portions 362, wherein said housing 122 comprises a ceiling portion 202 for covering the contact portions 322*a* or 322*b* of at least either of the first and second pieces of said contacts; wherein said pivoting member 162 comprises an actuating portion 462 for pivotally moving the pivoting member; the pushing portions 482 continuously arranged in the longitudinal direction of said pivoting member; and anchoring holes 50 independent from one another for receiving therein said pressure receiving portions 342, respectively; said pivoting member being mounted on said housing 122 so that said pushing portions 482 are pivotally moved between said connection portions and said pressure receiving portions of said contacts, during which pivotal movement, the axis 54 of rotation of said pushing portions 482 is moved with their pivotal movement to achieve their compact rotation, and said actuating portion 462 of the pivoting member is pivotally moved toward the fitting opening 182 of said housing 122 to bring the contact portions 322*a* of said contacts 142 into contact with said connecting object, and wherein said substrate 80 is provided with a notch 82 and said connector 10 is connected to said substrate 80 in a manner that said connector 10 is fitted in said notch 82, and fixtures 17 for fixing said housing to said substrate 80 are arranged at both longitudinal ends of said housing, and both or either of said fixtures 17 is provided with an extending piece 60 integral with or separate from said fixture 17 and extending substantially perpendicularly to said substrate 80 on the side of the connection portions 362 of said contacts 142 so that a rotated angle of said pivoting member 162 is limited by said extending piece 60 when pivoting member 162 is opened.

The third invention lies in the feature that instead of the contact portion 32*b*, a second piece 30 of each contacts is provided at one end with an extension portion 35 extending in an opposite direction from the insertion of said connecting object.

The fourth invention lies in the feature that instead of the contact portion 322*b* in the second invention, a second piece 302 of each contacts is provided at one end with an extension portion extending in an opposite direction from the insertion of said connecting object.

In the first to fourth inventions, it is preferable that said housing is provided with slits 21 at locations corresponding to said contacts 14 or 142 on the side of the housing in contact with said pivoting member 16.

In the first to fourth inventions, it is preferable that said housing 12 or 122 is further provided at both the longitudinal ends with extension portions each having a surface to contact said substrate 80, and said fixtures are arranged to cover lower surfaces of said extension portions at both the longitudinal ends of the housing so that said extending pieces come into contact with the wall 59 of said pivoting member on the side of its pivoted end, and that said connector is connected to said substrate so that said extension portions contact the lower surface of said substrate.

In the first to fourth inventions, it is preferable that said pivoting member 16 or 162 is provided at both its longitudinal ends with plate-shaped pieces 49 having an elasticity and partly separated from the body of the pivoting member by slits 47, respectively, and said plate-shaped pieces 47 are each provided at a tip with a protrusion 51, and that said fixtures are each provided with an extended portion 62 formed integrally with or separately from the fixture, which has an elasticity and extends substantially perpendicularly to the ceiling 20 of said housing 20 so that when said pivoting member is closed, the protrusions of said pivoting member engage insides of said extended portions. In addition, it is more preferable that said fixtures are each provided with an extended portion 62 to form a space 64 between said extended portion 62 and the side wall 66 of said housing 12 so that when said pivoting member 16 is closed, the protrusions 51 of said pivoting member 16 are fitted in said spaces 64, thereby securely holding said pivoting member.

In the first to fourth inventions, it is preferable that connecting object is provided on both longitudinal sides with anchoring portions, and said pivoting member is provided with engaging projections at locations corresponding to and adapted to engage said anchoring portions so that when said pivoting member is closed, the engaging portions engage said anchoring portions, respectively, thereby holding said connecting object. In addition, it is more preferable that the extension portions 22 of said housing are each provided with positioning pins 25 for positioning the housing relative to said substrate 80, said positioning pins 25 formed integrally with or separately from the extension portions on the side of the surfaces of the extension portions adapted to contact said substrate.

Moreover, it is preferable that the connector is connected to said substrate on the side of upper surfaces of the connection portions 36 of said contacts 14, and said pivoting member 16 is actuated on the opposite side from the surface of said substrate on which said connector is mounted.

In the first and third inventions, it is preferable that said housing is provided with protection walls at least at both ends of said ceiling portion for preventing said ceiling portion from being raised when said connecting object is accidentally forced upwardly. In addition, preferably said protection wall 27 is further provided at the center of said ceiling portion or over all said ceiling portion.

In the first to fourth inventions, it is preferable that said holding means comprises a projection 40 provided on said pressure receiving portion 34 of said first piece 28 of at least every other contact 14 to extend toward said connection portion 36, and a protrusion portion 42 provided in the proximity of tip of the connection portion 36 of said second piece 30 of said at least every other contact 14 to extend toward said pressure receiving portion.

Preferably, said holding means comprises a raised portion 44 provided between the connection portion 36 of said second piece 30 and said jointing portion 38 of at least every other contact 14 to extend toward said pressure receiving portion 34.

Further, it is preferable that the contacts 14 each provided with a projection 40 and a protrusion portion 42 and the contacts 14 each provided with a raised portion 44 are alternately arranged so that said projections, said protrusion portions and said raised portions are arranged to be alternately staggered.

In the first to fourth inventions, preferably the pressure receiving portion 34 of said first piece 28 is provided at its tip with an extended portion 39. Moreover, it is preferable that when said connecting object is connected to said connector 10, the pushing portions 48 of said pivoting member 16 are successively positioned such that before connecting said connecting object to said connector 10, the lower ends of the pushing portions 48 of said pivoting member 16 are in contact with said raised portions 44, that, second, when said actuating portion 46 is pivotally moved, the pushing portions 48 are pivotally moved about centers of curvatures of the lower ends of the pushing portions 48 as axes 54 of rotation, respectively, under the condition of the lower ends in contact with said raised portions 44 so that said pushing portions 48 assume slightly inclined positions, that, third, when said actuating portion is further pivotally moved, the pushing portions 48 are pivotally moved about centers of said pushing portions 48 as axes 54 of rotation, respectively, while the lower ends 58 of said pushing portions are somewhat moved from the second condition toward said connection portions 36 so that said pushing portions 48 assume substantially vertical positions, that, fourth, when said actuating portion is further pivotally moved, said lower ends 58 of the pushing portions are further moved from the third condition toward said connection portions 36 and upper ends 56 of said pushing portions 48 are moved toward said projections 40 so that said pushing portions 48 assume vertical positions, that, fifth, when said actuating portion is further pivotally moved, said lower ends 58 are further moved from the fourth condition toward said connection portions 36 and the upper ends 56 of said pushing portions 48 come into contact with said projections 40, and that, finally, when the actuating portion of the pivoting member is further pivotally moved from the fifth condition, said pushing portions 48 are pivotally moved about centers of curvatures of said upper ends 56 as axes 54 of rotation, respectively, whereby the contact portions 32 of said contacts 14 are brought into contact with said connecting object by pivotally moving said pivoting member toward the fitting opening of said housing.

The connector 10 according to the invention functions as follows. After a connecting object such as a flexible printed circuit board 70 or flexible flat cable has been inserted into the fitting opening 18 of the housing 12, the pushing portions 48 of said pivoting member 16 are caused to be pivotally moved between the connection portions 36 and the pressure receiving portions 34 of said contacts 14 to raise the pressure receiving portions 34 by the pushing portions 48 so that the jointing portions 38 of said contacts 14 are tilted toward said contact portions 32 about the one ends of the jointing portions 38 of said contacts 14 to push said contact portions 32 against the connecting object such as the flexible printed circuit board 70 or the flat cable.

As can be seen from the above descriptions, the connector according to the invention provides the following significant effects.

(1) According to the first and third inventions, while the reduced overall height of the connector (0.95 mm of the height of the mounted connector) can be maintained, the dead space of the substrate 80 can be reduced (making in the depth direction 3.5 mm), and any collision of said pivoting member 16 with the substrate 80 can be prevented and hence any damage to the pivoting member 16 and the substrate 80 can be eliminated.

(2) According to the second and fourth inventions, since the fitting opening 182 is positioned at the upper section of the housing, the space of the substrate can be more reduced in the depth direction in comparison with the first and third inventions. In the case that under the condition of a connecting object such as a flexible printed circuit board 70 with its one end inserted into the fitting opening 18 of the connector 10 according to the invention, when the other end of the connecting object is intended to be connected to a mating object of another connector, it is easy to force the connecting object such as the flexible printed circuit board to be connected to the mating object depending on its position ("to force the connecting object" means to cause the connecting object to be deformed and brought into contact with the mating object), and a dead space can be eliminated and further a smooth and stable connection can be obtained without applying any burden to the connecting object. Moreover, a longer locking length can be ensured in comparison with the front locking type or rear locking type of the prior art, while the part actuated by a finger of a hand becomes larger so that the stable connection can be obtained by a simple operation and a slight operating force.

(3) In the case that said connector 10 is connected to said substrate 80 in a manner that said extension portions 22 contact the lower surface of said substrate 80, the dead space of the substrate 80 can be reduced (making the length in the depth direction 4.0 mm, and shortening the length in the longitudinal direction by 2.0 to 3.0 mm), while maintaining the connection strength of the connector 10. When said pivoting member 16 is being pivotally moved, it does not contact the substrate 80 so that there is no damage to pivoting member 16 and the substrate 80.

(4) In the case that said pivoting member 16 is provided at both its longitudinal ends with plate-shaped pieces 49 having an elasticity and partly separated from the body of the pivoting member by slits 47, respectively, and said plate-shaped pieces 47 are each provided at a tip with a protrusion 51, and that said fixtures 17 are each provided with an extended portion 62 formed integrally with or separately from the fixture, which has an elasticity and extends substantially perpendicularly to the ceiling 20 of said housing 20 so that when said pivoting member 16 is closed, the protrusions 51 of said pivoting member 16 engage insides of said extended portions 62, even if the connecting object such as a flexible printed circuit board is accidentally forced upwardly, the pivoting member 16 is not rotated so that a stable connection is obtained.

(5) In the case that said fixtures are each provided with an extended portion 62 having an elasticity and extending substantially in parallel with a side wall 66 of said housing 12 to form a space 64 between said extended portion 62 and the side wall 66 of said housing 12 so that when said pivoting member 16 is closed, the protrusions 51 of said pivoting member 16 are fitted in said spaces 64, thereby securely holding said pivoting member, even if the connecting object such as a flexible printed circuit board is accidentally forced upwardly, the pivoting member 16 is not rotated so that a stable connection is obtained.

(6) In the case that said substrate 80 is provided on both longitudinal sides with anchoring portions 72, and said pivoting member 16 is provided with engaging projections 53 at locations corresponding to and adapted to engage said anchoring portions 72 so that when said pivoting member 16 is closed, the engaging portions 53 engage said anchoring portions 72, respectively, thereby holding said substrate 80, when the connecting object such as a flexible printed circuit board is inserted into the connector, the connecting object can be securely positioned, and even if the connecting object is accidentally forced upwardly, it is not shifted from its position so that stable connection can be obtained.

(7) In the case that the extension portions 22 of said housing are each provided with positioning pins 25 for positioning the housing relative to said substrate 80, said positioning pins 25 formed integrally with or separately from the extension portions on the side of the surfaces of the extension portions adapted to contact said substrate 80, the connector 10 can be mounted in an accurate position on the substrate 80, while the longitudinal dimension of the connector is not enlarged even when the positioning pins 25 are provided.

(8) In the case that the connector is connected to said substrate on the side of upper surfaces of the connection portions 36 of said contacts 14, and said pivoting member 16 is actuated on the opposite side from the surface of said substrate on which said connector is mounted, a reduced overall height of the connector is possible by the thickness of the substrate. As said pivoting member 16 can be actuated on the side of the surface of the substrate not having other parts and the connector 10 mounted thereon, the pivoting member 16 can be easily operated.

(9) In the first invention, said housing 12 is provided with protection walls 27 at least at both ends of said ceiling portion 20 for preventing said ceiling portion 20 from being raised when said connecting object is accidentally forced upwardly, and said holding means comprises a projection 40 provided on said pressure receiving portion 34 of said first piece 28 of at least every other contact 14 to extend toward said connection portion 36, and a protrusion portion 42 provided in the proximity of tip of the connection portion 36 of said second piece 30 of said at least every other contact 14 to extend toward said pressure receiving portion 34. Consequently, said pivoting member 16 is stably pivoted without any trouble, and further, as said pivoting member 16 is rotated toward the fitting opening, the occupied area of the substrate becomes smaller (less than 4.0 mm in the depth direction), and even if the connecting object is accidentally forced by an external force, a defective or failed connection does not occur so that the connection stability and connection holding force are improved as compared with the prior art.

(10) In the first to fourth inventions, said holding means comprises a raised portion 44 provided between the connection portion 36 of said second piece 30 and said jointing portion 38 of at least every other contact 14 to extend toward said pressure receiving portion 34. Accordingly, said pivoting member 16 is stably pivoted without any trouble, and further, as said pivoting member 16 is rotated toward the fitting side, the occupied area of the substrate becomes smaller (less than 4.0 mm in the depth direction).

(11) In the case that in the first to fourth inventions the contacts 14 each provided with a projection 40 and a protrusion portion 42 and the contacts 14 each provided with a raised portion 44 are alternately arranged so that said projections, said protrusion portions and said raised portions are arranged to be alternately staggered, said pivoting member 16 is stably pivoted without any trouble, and further, as said pivoting member 16 is rotated toward the fitting opening, the occupied area of the substrate becomes smaller (less than 4.0 mm in the depth direction), thereby achieving extremely narrow pitches of conductors of the connector.

(12) In the case that in the first to fourth inventions, the pressure receiving portion 34 of said first piece 28 is provided at its tip with an extended portion 39, the extended portions 39 serve to resist to strong reaction forces against the pivotal movement of the pivoting member 16 when it is pivotally moving so that the deformation of the center of said housing 12 toward the fitting opening can be effectively prevented.

(13) In the case that in the first and third inventions, the protection wall 27 is further provided at the center of said ceiling portion or over all said ceiling portion, when the connecting object such as a flexible printed circuit board 70 is accidentally forced upwardly, the housing 12 is prevented from moving upwardly so that the stable connection can be obtained and any defective connection can be prevented.

(14) In the first to fourth inventions, when said connecting object is connected to said connector 10, the pushing portions 48 of said pivoting member 16 are successively positioned such that before connecting said connecting object to said connector 10, the lower ends of the pushing portions 48 of said pivoting member 16 are in contact with said raised portions 44, that, second, when said actuating portion 46 is pivotally moved, the pushing portions 48 are pivotally moved about centers of curvatures of the lower ends of the pushing portions 48 as axes 54 of rotation, respectively, under the condition of the lower ends in contact with said raised portions 44 so that said pushing portions 48 assume slightly inclined positions, that, third, when said actuating portion is further pivotally moved, the pushing portions 48 are pivotally moved about centers of said pushing portions 48 as axes 54 of rotation, respectively, while the lower ends 58 of said pushing portions are somewhat moved from the second condition toward said connection portions 36 so that said pushing portions 48 assume substantially vertical positions, that, fourth, when said actuating portion is further pivotally moved, said lower ends 58 of the pushing portions are further moved from the third condition toward said connection portions 36 and upper ends 56 of said pushing portions 48 are moved toward said projections 40 so that said pushing portions 48 assume vertical positions, that, fifth, when said actuating portion is further pivotally moved, said lower ends 58 are further moved from the fourth condition toward said connection portions 36 and the upper ends 56 of said pushing portions 48 come into contact with said projections 40, and that, finally, when the actuating portion of the pivoting member is further pivotally moved from the fifth condition, said pushing portions 48 are pivotally moved about centers of curvatures of said upper ends 56 as axes 54 of rotation, respectively, whereby the contact portions 32 of said contacts 14 are brought into contact with said connecting object by pivotally moving said pivoting member toward the fitting opening of said housing. Accordingly, the pushing portions 48 of said pivoting member 16 are pivotally moved about axes 54 of rotation which are not stationary but displaceable so that the pushing portions perform the compact rotation which also leads to a reduced overall height of the connector 10.

BRIEF DESCRIPTION OF THE DRAWINGS

FIG. 1 (B) is a perspective view of the connector according to the invention with the pivoting member opened, viewed from the side of the connection portion;

FIG. 2 (B) is a perspective view of the connector according to the invention mounted on the substrate with the pivoting member opened, viewed from the side of the connection portion;

FIG. 3 (B) is a perspective view of the connector according to the invention with a flexible printed circuit board inserted and the pivoting member closed, and part of the connector being cut along the one contact and removed;

FIG. 4 (B) is a perspective view of another contact;

FIG. 9 (B) is a perspective view of the modified connector according to the invention mounted on a substrate with the pivoting member closed, viewed from the side of the fitting opening;

FIG. 10 (B) is a perspective view of the another connector according to the invention with the pivoting member opened, viewed from the connection portion;

FIG. 11 (B) is a perspective view of the another connector mounted on the substrate with the pivoting member opened, viewed from the side of the connection portion;

FIG. 12 (B) is a perspective view of the another connector according to the invention with a flexible printed circuit board inserted and the pivoting member closed, and part of the connector being cut off along one contact and removed;

FIG. 16 (B) is a sectional view of the further connector according to the invention with a flexible printed circuit board inserted and the pivoting member closed, taken along the one contact.

DESCRIPTION OF THE PREFERRED EMBODIMENTS

Figure 1A:
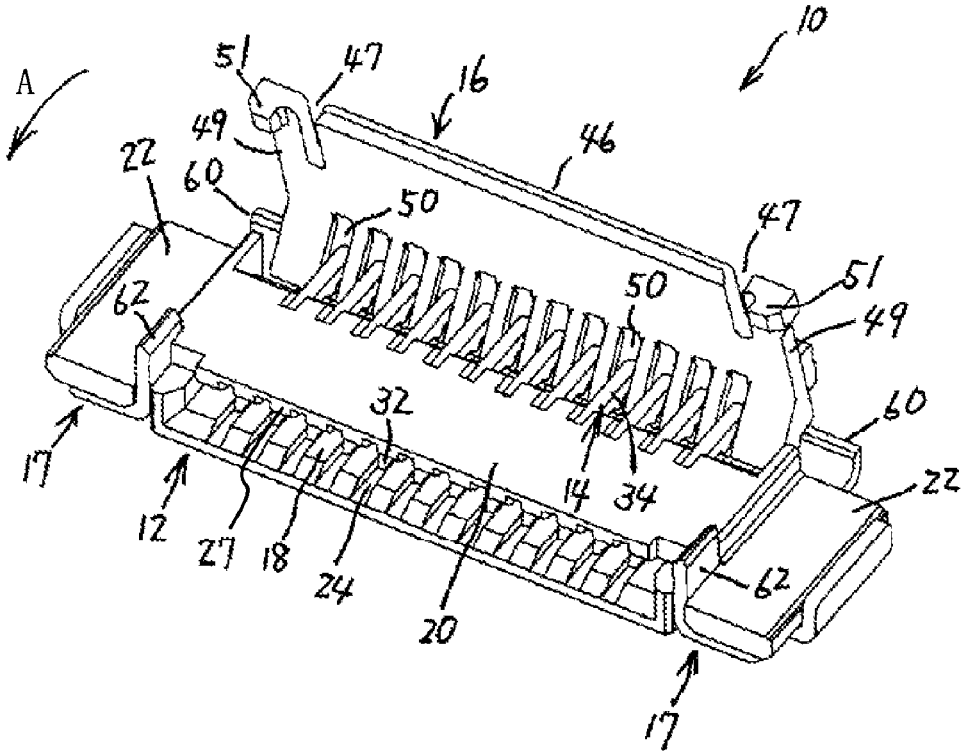
FIG. 1 (A) is a perspective view of the connector according to the invention with its pivoting member opened, viewed from the above on the side of the fitting opening.
Figure 1B:
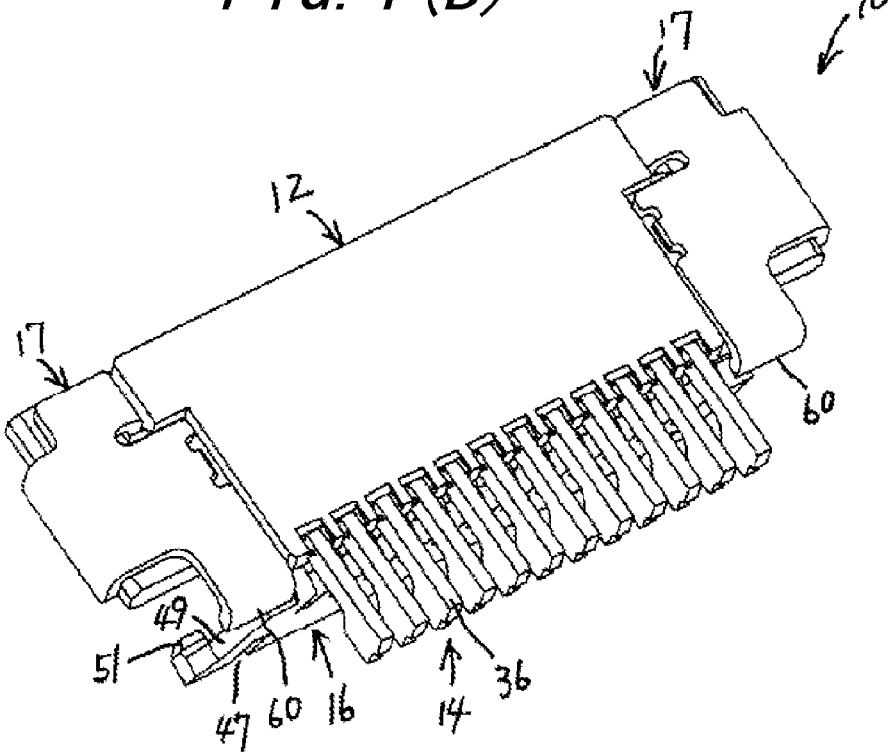
Figure 2A:
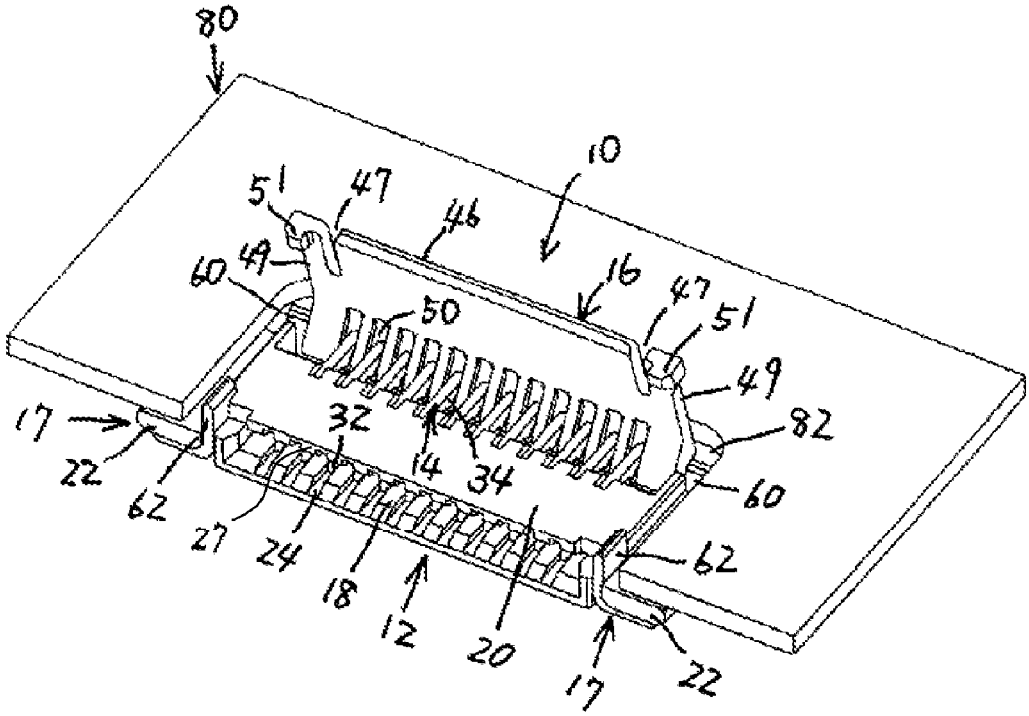
FIG. 2 (A) is a perspective view of the connector according to the invention mounted on a substrate with the pivoting member opened, viewed from the side of the fitting opening.
Figure 2B:
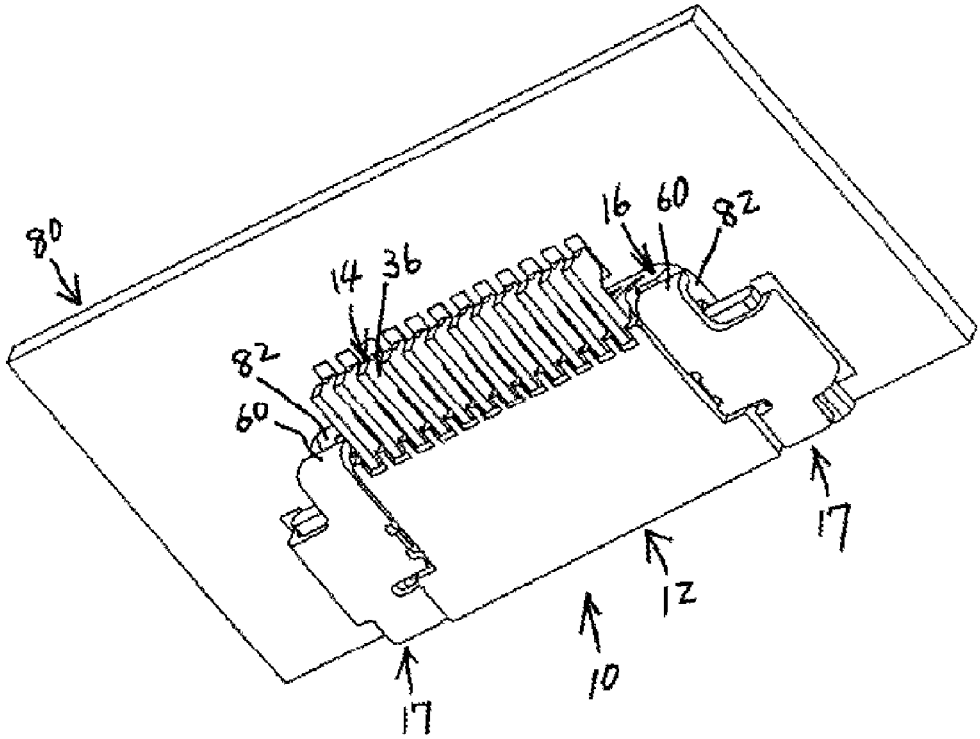
Figure 3A:
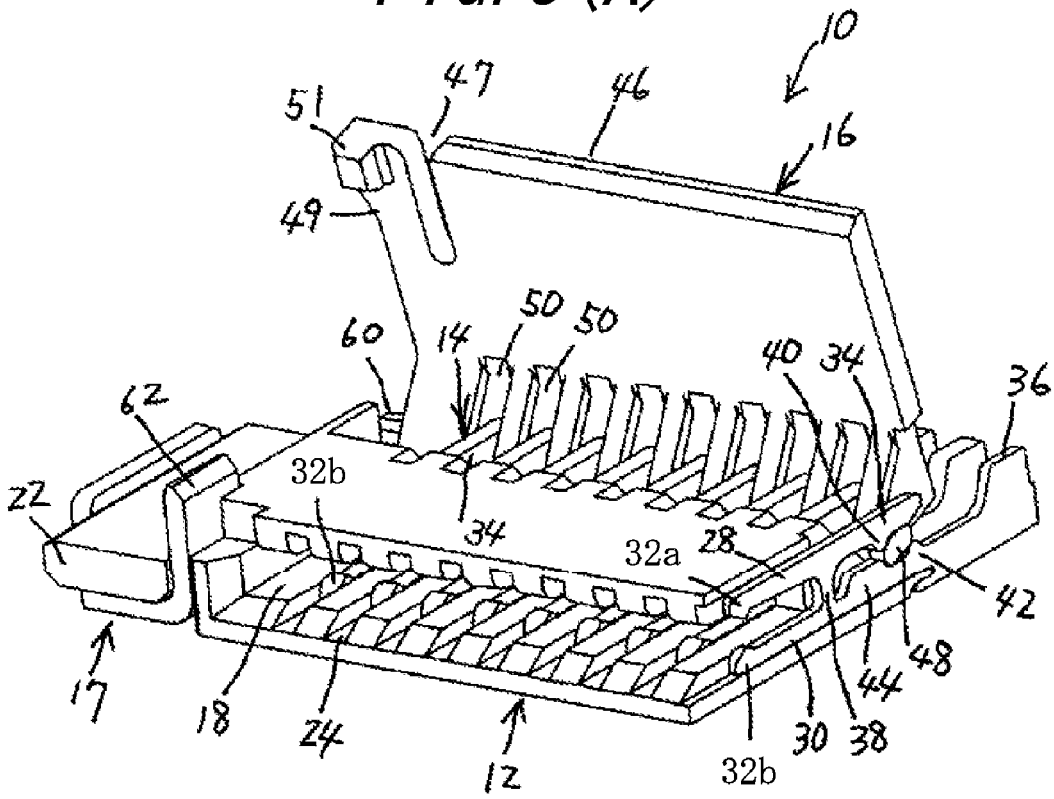
FIG. 3 (A) is a perspective view of the connector according to the invention with the pivoting member opened, and part of the connector being cut off along one contact and removed.
Figure 3B:
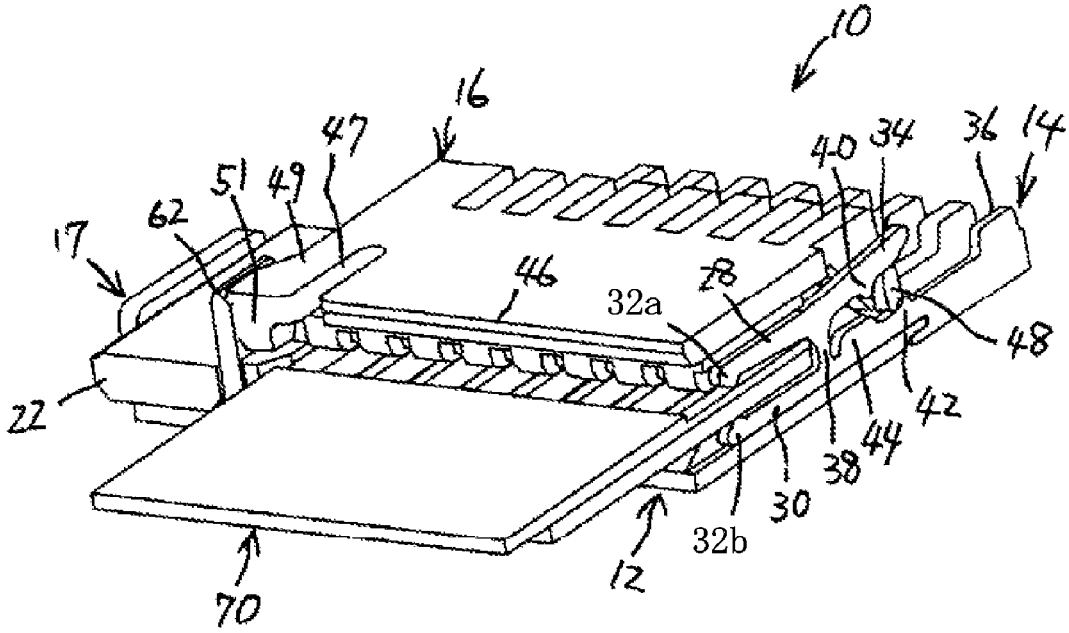
Figure 4A:
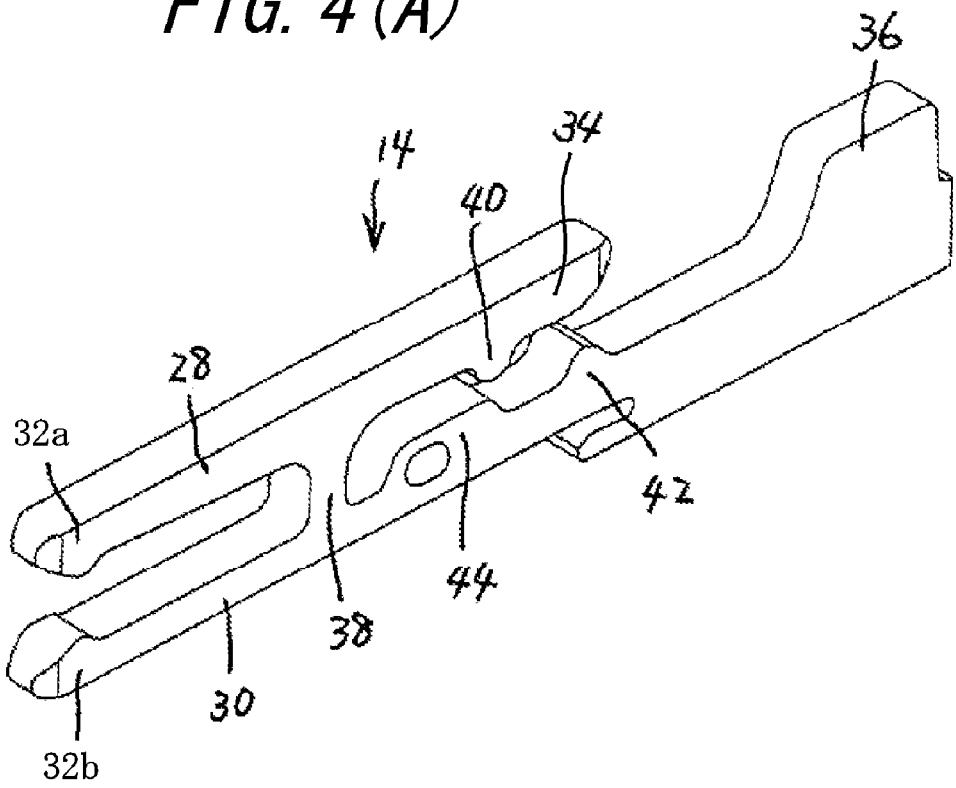
FIG. 4 (A) is a perspective view of a contact used in the above connector.
Figure 4B:
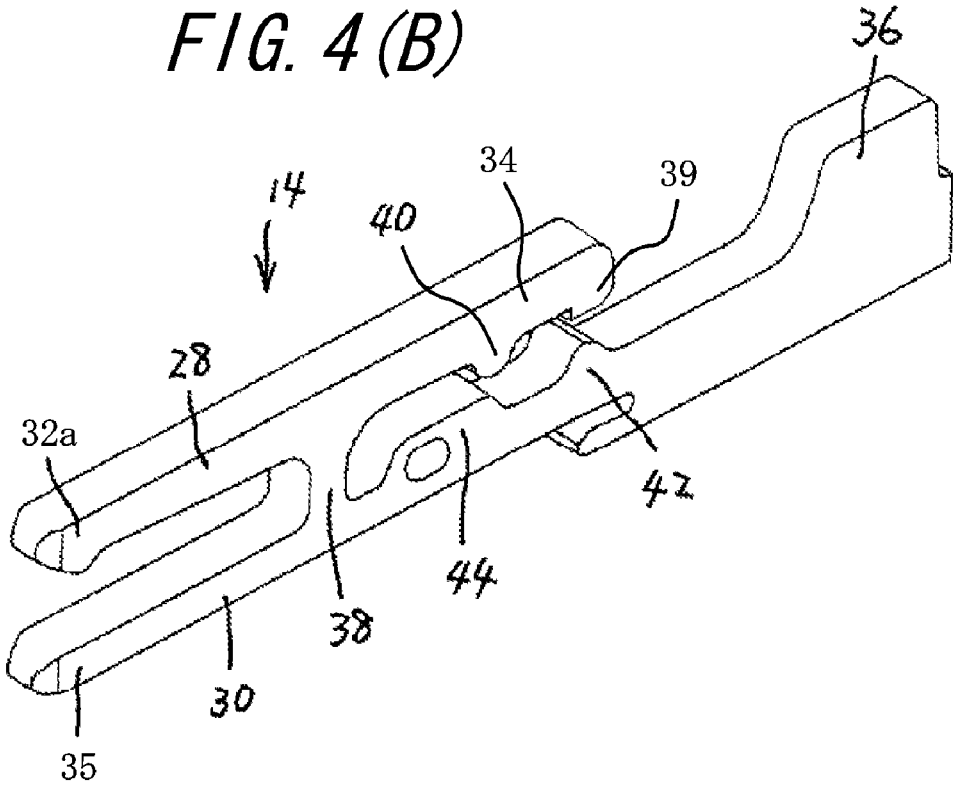
Figure 5:
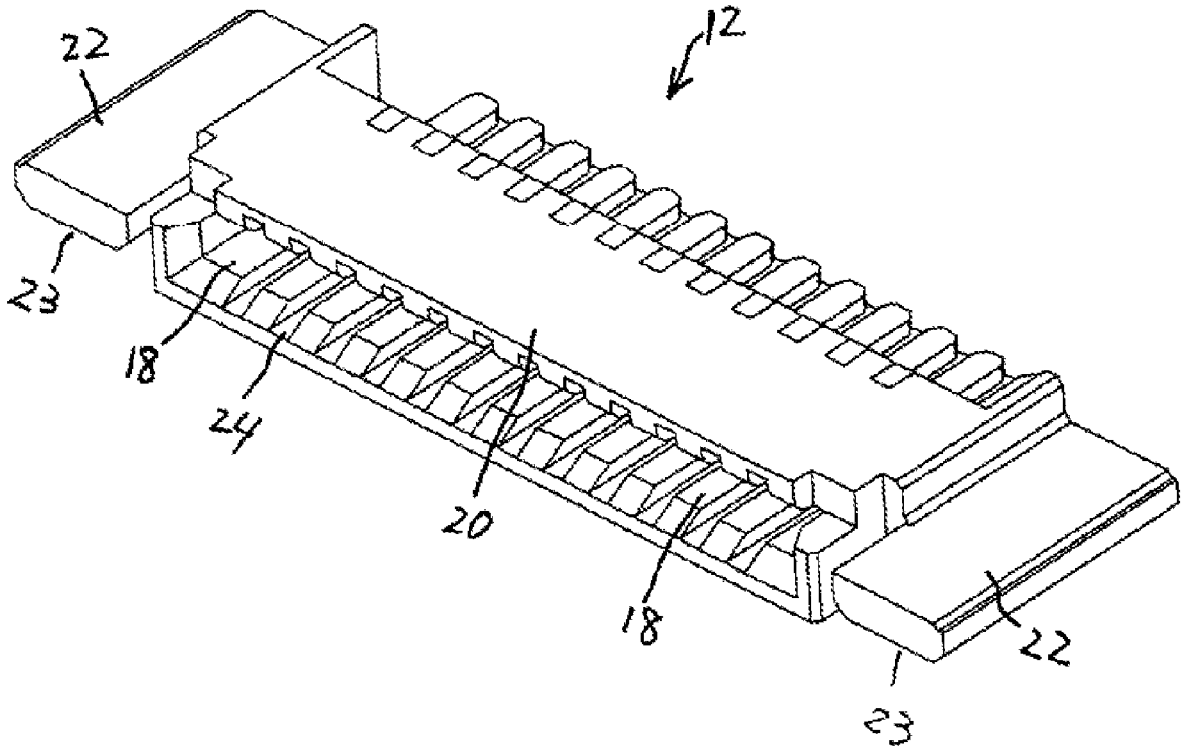
FIG. 5 is a perspective view of a housing used in the above connector.
Figure 6:
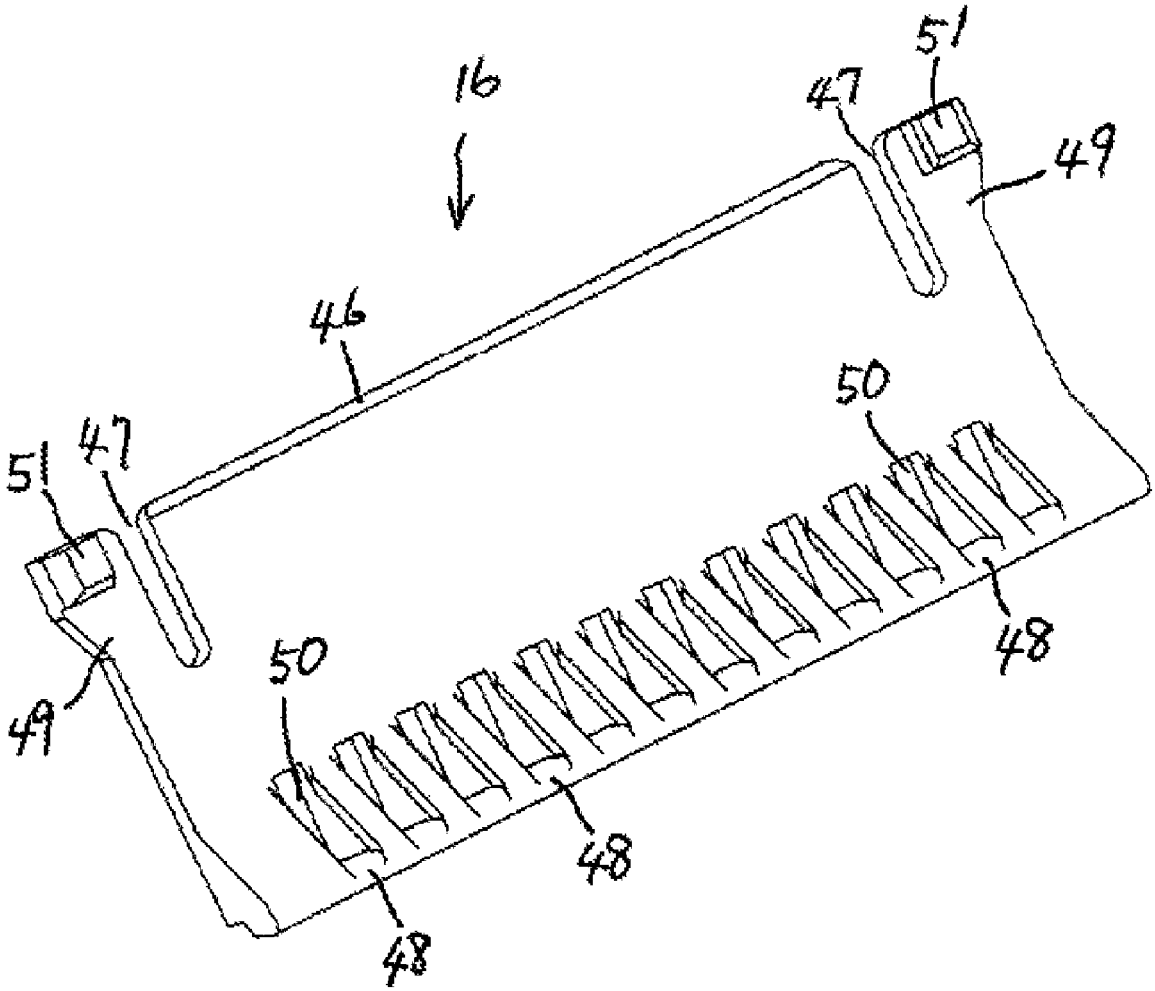
FIG. 6 is a perspective view of a pivoting member used in the above connector.
Figure 7:
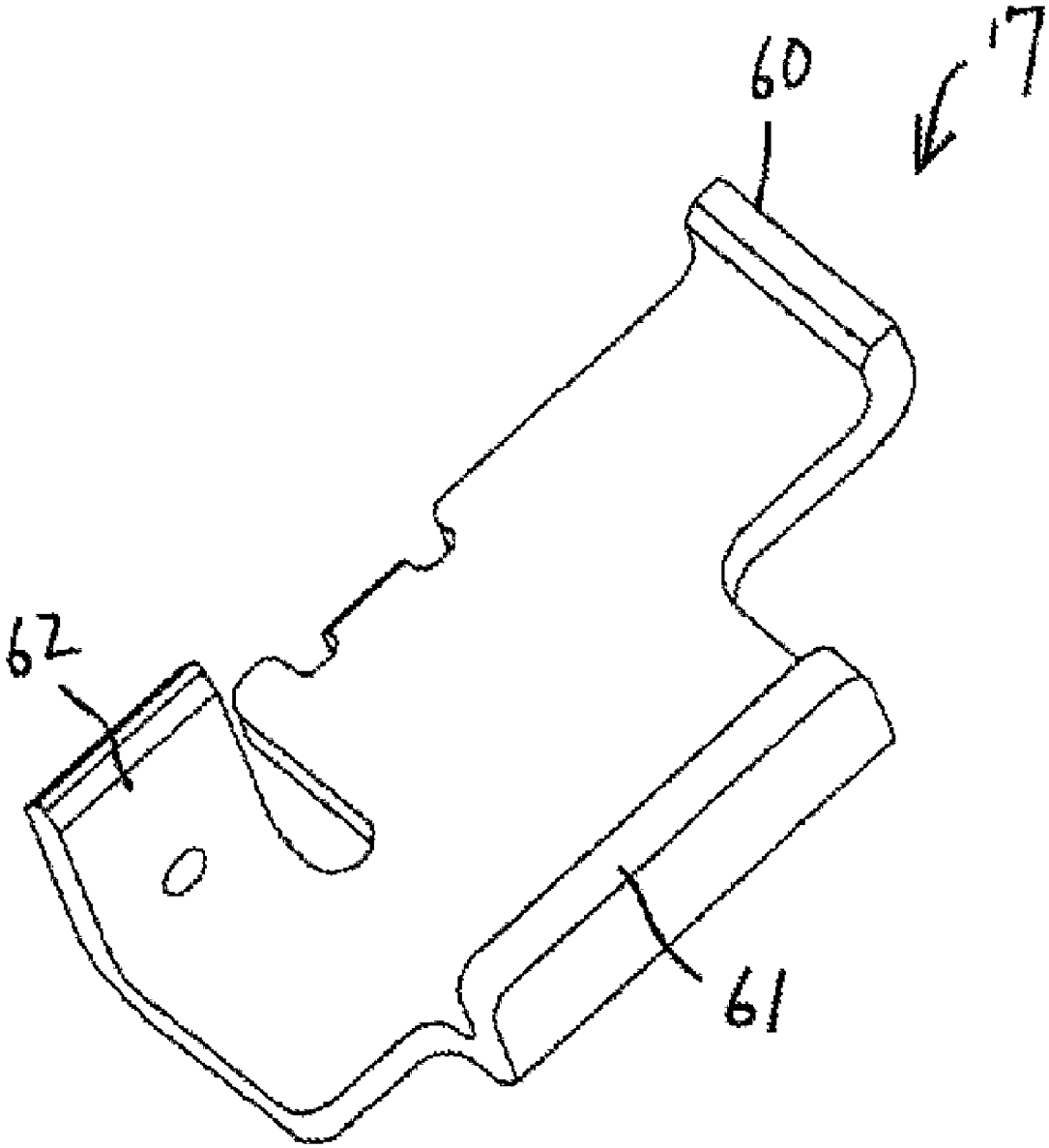
FIG. 7 is a perspective view of a fixture used in the above connector.
Figure 8A:
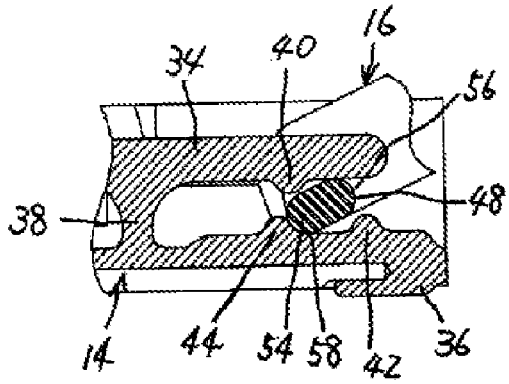
FIGS. 8 (A) to 8 (F) are explanatory views for explaining movements of the pushing portions and axis of rotation when the pivoting member is pivotally moved.
Figure 8B:
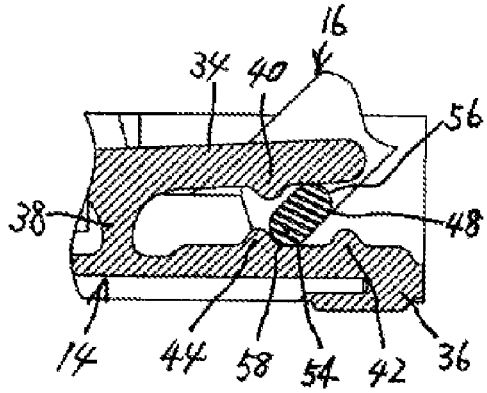
Figure 8C:
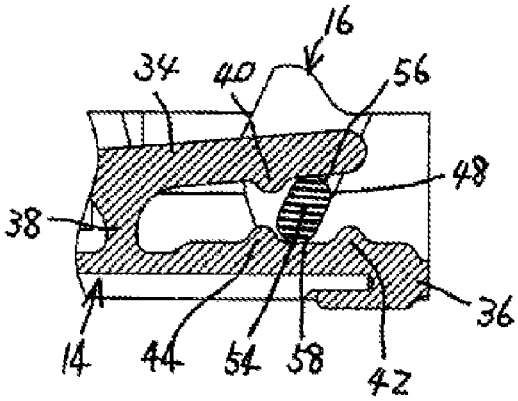
Figure 8D:
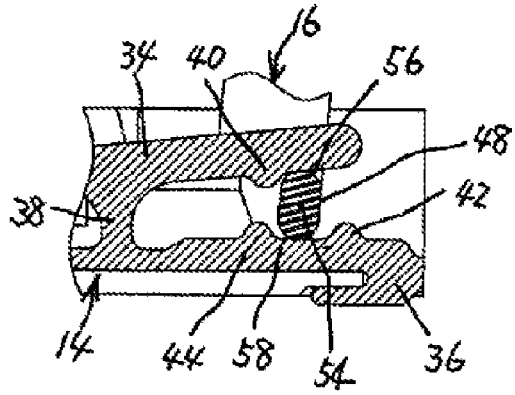
Figure 8E:
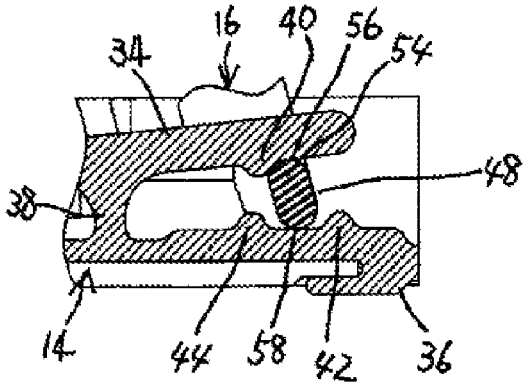
Figure 8F:
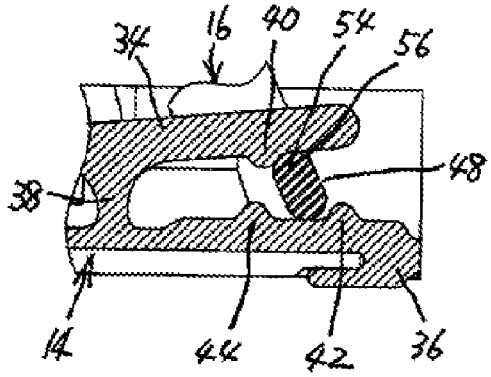

One typical embodiment (Embodiment 1) of the connector according to the invention will be explained with reference to FIGS. 1 to 8. FIG. 1 (A) is a perspective view of the connector according to the invention with its pivoting member opened, viewed from the side of the fitting opening, and FIG. 1 (B) is a perspective view of the connector according to the invention with the pivoting member opened, viewed from the side of the connection portion. FIG. 2 (A) is a perspective view of the connector according to the invention mounted on a substrate with the pivoting member opened, viewed from the side of the fitting opening, while FIG. 2 (B) is a perspective view of the connector according to the invention mounted on the substrate with the pivoting member opened, viewed from the side of the connection portion. FIG. 3 (A) is a perspective view of the connector according to the invention with the pivoting member opened, and part of the connector being cut along one contact and removed, and FIG. 3 (B) is a perspective view of the connector according to the invention with a flexible printed circuit board inserted and the pivoting member closed, and part of the connector being cut along one contact and removed. FIG. 4 (A) is a perspective views of the contact used in the connector shown in FIGS. 1 to 3, and FIG. 4 (B) is a perspective view of another contact. FIG. 5 is a perspective view of a housing used in the connector, while FIG. 6 is a perspective view of the pivoting member, and FIG. 7 is a perspective view of a fixture. FIGS. 8 (A) to (F) are explanatory views for explaining movements of the pushing portion and axis of rotation when the pivoting member is pivotally moved from its opened state to the closed position.

The connector according to the invention mainly comprises a housing 12, a pivoting member 16, contacts 14, and fixtures 17.

The components of the connector 10 according to the invention will be explained with reference to the drawings.

First, the contacts 14 will be explained. The contacts 14 are made of a metal and formed by means of the press-working of the known technique. Preferred metals from which to form said contacts include brass, beryllium copper, phosphor bronze and the like which comply with the requirements as to springiness, electric conductivity, and the like.

In the embodiment, said contacts 14 are of an inverted H-shaped as shown in FIG. 4 (A). The contacts 14 each comprise a first piece 28 having at one end a contact portion 32*a* adapted to contact a connecting object and at the other end a pressure receiving portion 34 adapted to be pushed by said pivoting member 16, a second piece 30 having at one end a further contact portion 32*b* adapted to contact the connecting object and at the other end a connection portion 36 to be connected to a substrate, and a jointing portion 38 for connecting said first piece 28 and said second piece 30. The contact portion 32*a* of said first piece 28, said jointing portion 38, and said connection portion 36 are arranged substantially in the form of a crank, while holding means are provided for permitting pushing portions 48 of said pivoting member 16 to be pivoted or pivotally moved between said pressure receiving portions 34 and said connection portions 36 of the contacts 14.

Said contact portions 32*a* and 32*b* are of a protruded shape for facilitating the contact with a connecting object such as a flexible printed circuit board 70 or flexible flat cable. In the embodiment, said connection portions 36 are of a surface mounting type (SMT) as shown in FIGS. 1 (A) and (B), but they may be of a dip type. In the embodiment, one contact 14 is provided with two contact portions 32*a* and 32*b* between which the flexible printed circuit board 70 or flexible flat cable is embraced. In other words, as the contact portions 32*a* and 32*b* are positions on both the sides of the inserting direction of the flexible printed circuit board 70 or flat cable, the circuit board or flat cable is embraced by the contact portions 32*a* and 32*b*, thereby securely bringing the contact portions into contact with the circuit board 70 or flat cable and simultaneously enabling the connector to accommodate a case of a circuit board having contacts only on either of its surfaces.

Said jointing portions 38 and said pressure receiving portions 34 serve to achieve the following functions when a connecting object such as a flexible printed circuit board 70 or flexible flat cable is inserted into the connector. After the connecting object such as the flexible printed circuit board 70 or flexible flat cable has been inserted into a fitting opening 18 of the housing 12, when pushing portions 48 of the pivoting member 16 are pivotally moved between the connection portions 36 and the pressure receiving portions 34 of said contacts 14, said pressure receiving portions 34 are raised by the pushing portions 48 so that the jointing portions 38 of said contacts 14 are tilted toward said contact portion 32*a* about lower ends 58 of the jointing portions 38 of the contacts 14, thereby causing said contact portions 32*a* to be pushed against the connecting object such as the flexible printed circuit board 70 or flat cable. The sizes and shapes of said joining portions 38 and said pressure receiving portions 34 may be suitably designed so as to achieve such functions.

As said holding means, a projection 40 is provided on at least every other contact 14 arranged in a row so as to extend from the pressure receiving portion 34 of said first piece 28 toward said connecting portion 36 and further a protrusion portion 42 is provided on the at least every other contact 14 so as to extend from the proximity of the tip of the connection portion 36 of said second piece 30 toward said pressure receiving portion 34. The shapes and the sizes of said projections 40 and said protrusion portions 42 may be suitably designed so as to obtain a stable pivotal movement of the pushing portions 48 without dislodgment of the pushing portions 48 of said pivoting member 16 when the pushing portions 48 are pivotally moving. In the embodiment, the projections 40 and the protrusion portions 42 are substantially rounded to avoid any damage of the pushing portions 48 of said pivoting member 16.

As said holding means, moreover, a raised portion 44 is provided on at least every other contact 14 so as to extend from the second piece 30 between the connection portion 36 and the jointing portion 38 toward said pressure receiving portion 34. The contacts 14 each having said projection 40 and said protrusion portion 42 and the contacts 14 each having said raised portion 44 are alternately arranged so that said projections 40, said protrusion portions 42 and said raised portions 44 are arranged to be alternately staggered. With this arrangement of the contacts 14, the pushing portions 48 of said pivoting member 16 will be more smoothly pivoted. The shape and size of said raised portions 44 may be suitably designed so as to obtain a stable pivotal movement of the pushing portions 48 without dislodgment of the pushing portions 48 of the pivoting member when the pushing portions 48 are pivotally moving. In the embodiment, the raised portions 44 are substantially rounded to avoid any damage of the pushing portions 48 of said pivoting member 16. As shown in FIG. 4 (A), moreover, all said projection 40, said protrusion portion 42, and said raised portion 44 may be provided on the same contact 14.

Further, when the pushing portions 48 of said pivoting member 16 are pivoted or pivotally moved between the pressure receiving portions 34 and the connection portions 36 of the contacts 14, the center of the pivoting member 16 is often deformed in the direction shown by an arrow A in FIG. 1 (A) due to strong reaction forces against the pivotal movement of the pivoting member 16. In this case, by providing an extended portion 39 at the tip end of the pressure receiving portion 34 of said first piece 28 of each of the contacts as shown in FIG. 4 (B), the deformation of the center of the pivoting member 16 will be effectively prevented. The size of said extended portions 39 may be any one insofar as they can achieve the function described above, and may be suitably designed to an extent such that the pushing portions 48 of the pivoting member 16 can engage the extended portions 39.

The pivoting member 16 will then be explained. The pivoting member 16 is formed from an electrically insulating plastic material by means of the injection molding of the known technique. The materials for the pivoting member 16 may be suitably selected in consideration of dimensional stability, workability, manufacturing cost, and the like and generally include polybutylene terephthalate (PBT), polyamide (66 PA or 46 PA), liquid crystal polymer (LCP), polycarbonate (PC) and the like and combination thereof. The pivoting member 16 has a substantially L-shaped cross-section and mainly comprises an actuating portion 46, axles 52 adapted to be fitted in the housing 12 in a pivotally movable and displaceable manner (fitted in the housing with clearances which permit the displacements of the pushing portions as described with reference to FIGS. 8 (A) to (F)), the pushing portions 48 for pushing the pressure receiving portions 34 of said contacts 14, and anchoring holes 50 adapted to receive the pressure receiving portions 34 of said contacts 14. The axles 52 are a fulcrum for pivotally moving the pivoting member 16 and suitably fitted in the housing 12 at its longitudinal ends so as to enable the pivoting member 16 to pivotally move.

Said pushing portions 48 are for pushing the pressure receiving portions 34 of the contacts 14. The pushing portions 48 are preferably of an elongate shape in cross-section, and elliptical in the embodiment. With such an elliptical shape, when the pivoting member is pivotally moved in the direction shown by the arrow A as shown in FIG. 1 (A) so as to pivotally move its pushing portions 48 between the pressure receiving portions 34 and the connection portions 36 of the contacts 14, the pressure receiving portions 34 of the contacts 14 are moved upwardly with the aid of the variation in contact height of the pushing portions 48 owing to, for example, difference in major and minor axes of an ellipse so that the contact portions 32*a* of the contacts 14 are forced against the connecting object such as the flexible printed circuit board 70 or flexible flat cable. The shape of the pushing portions 48 may be of any one so long as the pushing portions 48 can be pivotally moved between the pressure receiving portions 34 and the connection portions 36 of the contacts 14, and the pressure receiving portions 34 of the contacts 14 can be raised with the aid of the variation in contact height such as difference in major and minor axes of the elliptical cross-section of the pushing portions 48.

In order to prevent the center of the pivoting member 16 from being deformed in the direction shown by the arrow A in FIG. 1 (A) owing to the strong reaction forces against the pivotal movement of the pivoting member 16 when it is pivotally moving, the pivoting member 16 is preferably provided with anchoring holes 50 independently from one another which are adapted to be engaged by the extended portions 39 of said contacts 14. The anchoring holes 58 provided independently from one another will contribute to enhancing the strength of the pivoting member 16 and prevent the deformation of the pivoting member when it is pivotally moving.

Said pivoting member 16 is preferably provided with plate-shaped pieces 49 at both the longitudinal ends, which are partly separated from the body of the pivoting member 16 by slits 47 so as to have an elasticity, and preferably the plate-shaped pieces 49 are each provided at its tip with a protrusion 51. The protrusions 51 at both the longitudinal ends engage insides of the two fixtures 17 as shown in FIG. 3 (B), thereby securely holding said pivoting member 16. The slits 47 provide the elasticity to said plate-shaped pieces 49 by supporting them in a cantilevered manner. The positions of said plate-shaped pieces 49 and the protrusions 51 at their tips are designed so as to engage the inside of the two fixtures 17. Moreover the sizes of the plate-shaped pieces 49 and the protrusions 51 at their tips may be suitably designed taking into account their functions, the elasticity, the strength and the like.

The housing 12 will then be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66 PA or 46 PA), liquid crystal polymer (LCP), polycarbonate (PC) and the like and combination thereof.

Said housing 12 is formed with inserting holes 24 in which a required number of contacts 14 are installed by press-fitting, hooking (lancing), welding or the like.

As shown in FIG. 2 (A), said housing 12 is provided with a ceiling portion 20 for covering the contact portions 32 of the first pieces 28 of said contacts 14 and at both the longitudinal ends with extension portions 22 each having a surface adapted to contact the substrate 80. The extension portions 22 serve to secure the fixtures 17 to the connector. The extension portions 22 are located in parallel with the substrate 80 and in contact with the lower surface of the substrate 80 so as to extend from both the longitudinal ends of the housing. The size of said extension portions 22 is suitably designed taking into account a reduced overall height, strength and the like of the connector 10. In the embodiment, the thickness of the extension portions 22 is so determined that the total thickness of the extension portion and the substrate 80 becomes thinner than the thickness of the overall thickness of the connector 10 with the pivoting member 16 closed. In other words, the extension portions 22 in contact with the lower surface of said substrate 80 lead to an increased connecting strength to the substrate and smaller dead spaces of the connector 10 in longitudinal directions.

Figure 9A:
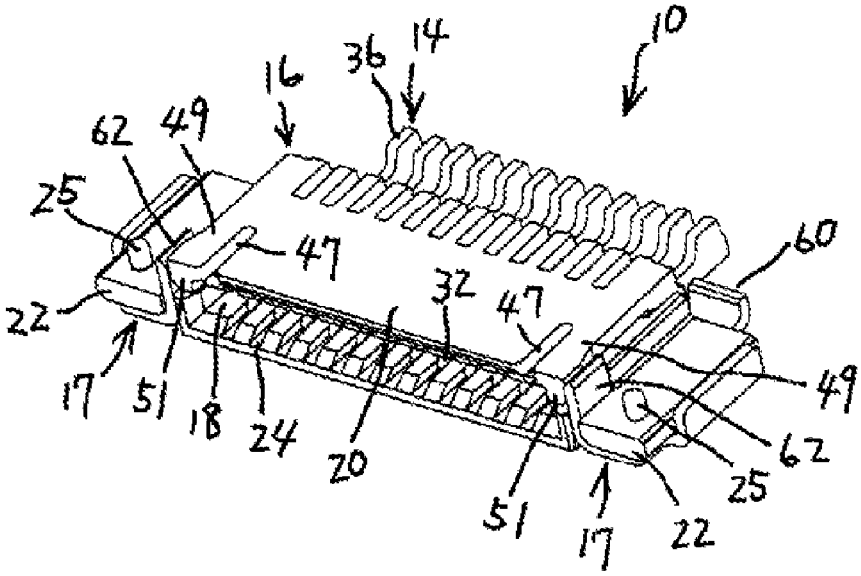
FIG. 9 (A) is a perspective view of a modified connector according to the invention with a pivoting member closed, viewed from the side of the fitting opening.
Figure 9B:
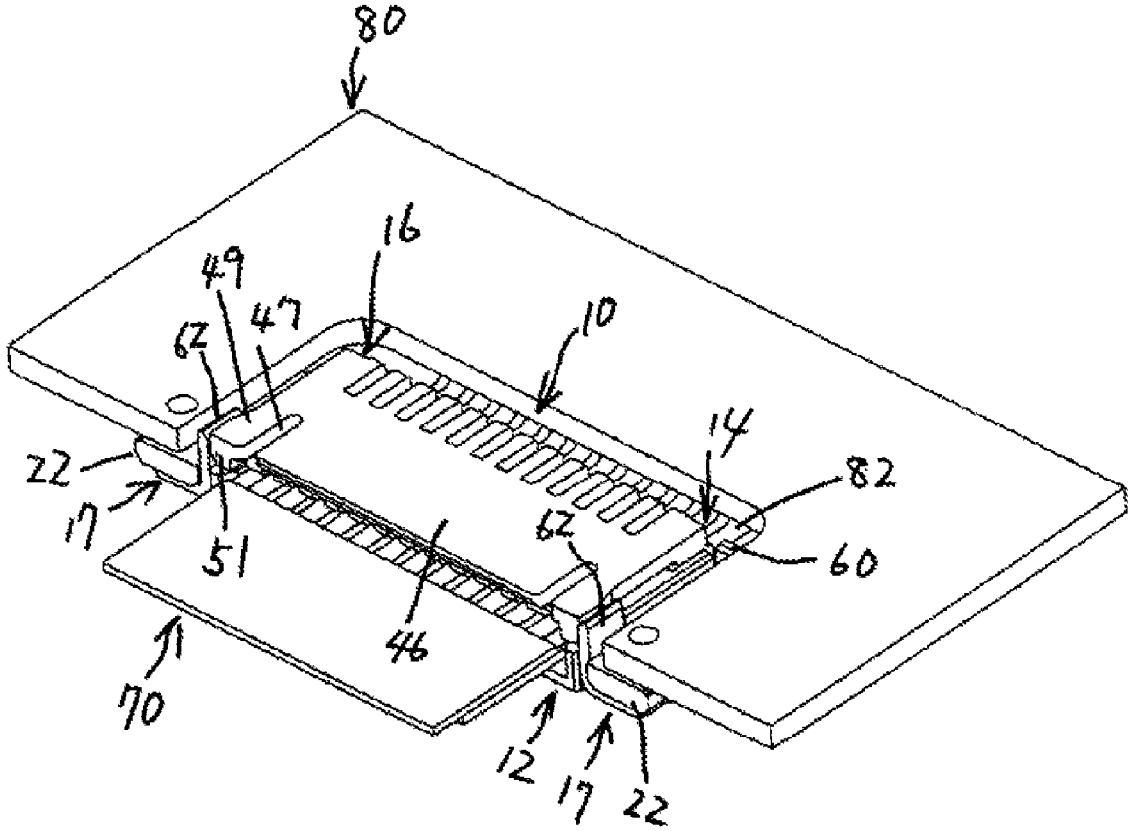

In addition, FIG. 9 (A) is a perspective view of a modified connector according to the invention with its pivoting member closed, viewed from the side of the fitting opening, and FIG. 9 (B) is a perspective view of the connector according to the invention mounted on a substrate with the pivoting member closed, viewed from the side of the fitting opening. It is preferable to provide positioning pins 25 in extension portions 22 for positioning the connector relative to the substrate 80, which are integral with or separate from the extension portions 22 of the housing 12 on the side of the surfaces adapted to be in contact with said substrate 80 as shown in FIGS. 9 (A) and (B). Said positioning pins 25 serve to accurately position the connector relative to the substrate 80, and it is desirable to form the positioning pins 25 integrally with the extension portions 22 of the housing 12 in consideration of manufacturing cost and workability. The positions of the positioning pins 25 may be at any positions insofar as the connector is accurately positioned relative to the substrate and are preferably located at both the longitudinal ends of the connector from the standpoint of balancing.

Said ceiling portion 20 of the housing on the side of the fitting opening 18 is preferably tapered or rounded or chamfered at the edge to facilitate the insertion of the flexible printed circuit board 70 or the like. Moreover, the ceiling portion 20 is preferably provided with a plurality of slits 21 at locations corresponding to said contacts 14 for receiving the first pieces of said contacts 14, respectively. The size of the slits 21 is somewhat larger than the first pieces of the contacts 14 and may be suitably designed in consideration of the sizes of the contacts 14 and the strength and function of said housing 12. The first pieces of the contacts 14 are accommodated in the slits 21 to achieve the reduced overall height of the connector.

The fixtures 17 will then be explained. The fixtures 17 are made of a metal and formed by means of the press-working of the known technique. Preferred metals from which to form said fixtures 17 include brass, beryllium copper, phosphor bronze and the like which comply with the requirements as to springiness, connectivity, dimensional stability, and the like.

Said fixtures 17 are substantially U-shaped in cross-section and are preferably fixed to the extension portions 22 of said housing to cover the lower surfaces 23 of the extension portions 22 by press-fitting, integral molding (molding the housing together with the fixtures previously arranged in a mold for molding the housing), welding or the like. The positions of said fixtures 17 are designed taking into account customer's specifications, mounting position relative to the substrate 80, and the like. In the embodiment, the substrate 80 is formed with a notch 82 and the connector 10 is mounted on the substrate 80 from the side of the substrate having other parts mounted thereon so that the substrate 80 is positioned substantially at the middle of the thickness or height of the connector and the pivoting member 16 is actuated on the side of the substrate 80 opposite from the other parts mounted thereon. The size of said fixtures 17 is designed in consideration of the holding forces of the fixtures, occupied areas on the substrate and the like.

Said fixtures 17 are each preferably provided with an extending piece 60 integrally with or separately from the fixture, which extends perpendicularly to the substrate 80 on the side of the connection portions 36 of said contacts 14 and is adapted to contact the wall 59 of the pivoting member 16 on the side of the pivoted end. Said extending piece 60 is preferably formed integrally with the fixture 17 in view of the manufacturing cost. The extending piece 60 may be provided on both the fixtures 17 located at both the longitudinal ends of the connector 10, or the extending piece 60 may be provided only on either of the fixtures 17. However, it will be preferable to provide the extending pieces 60 at both the longitudinal ends of the connector 10 taking into account the balancing. Said extending pieces 60 serve to limit a rotated angle of said pivoting member 16 when it has been opened. In the embodiment, the rotated angle of the pivoting member 16 is limited to 75°. The positions and the size of said extending pieces 60 may be suitably designed in consideration of such functions, workability, strength and the like of said fixtures 60.

Said fixtures 17 are each preferably provided with an extended portion 62 formed integrally with or separately from the fixture 17, which has an elasticity and extends substantially perpendicularly to the ceiling portion 20 of said housing 12. Preferably, said extend portion 62 is formed integrally with said fixture 60 taking into account the manufacturing cost. The extended portions 62 of the fixtures 60 serve to securely hold said pivoting member 16 when the protrusions 51 of said pivoting member 16 at both the longitudinal ends engage the extended portions 62 of the fixtures arranged at both the longitudinal ends of the connector 10 as described above. The positions and the shape of said extended portions 62 may be suitably designed in consideration of these functions, workability, strength and the like. The extended portions 62 have an elasticity for facilitating the engagement of the protrusions 51 of said pivoting member 16 and securely achieving the holding of the pivoting member 16.

The movement and pivotal movement of the pushing portions 48 of said pivoting member 16 will then be explained with reference to FIGS. 8 (A) to (F). FIG. 8 (A) illustrates a state that the lower end 58 of the pushing portion 48 of said pivoting member 16 is in contact with the raised portion 44 before the connecting object is connected to the connector 10.

As shown in FIG. 8 (B), when the actuating portion 46 of the pivoting member 16 is pivotally moved (in the counterclockwise direction viewed in the drawing), the pushing portion 48 is pivotally moved about the center (axis 54 of rotation) of the curvature of the lower end 58 of the pushing portion 48 which is in contact with the raised portion 44, whereby the pushing portion 48 assumes a slightly inclined position.

As shown in FIG. 8 (C), when the actuating portion 46 of the pivoting member 16 is further pivotally moved, the lower end 58 somewhat moves from the position shown in FIG. 8 (B) toward the connection portion 36 so that the pushing portion 48 is pivotally moved about the center (axis 54 of rotation in this stage) of the pushing portion 48, whereby the pushing portion 48 assumes a substantially vertical position.

As shown in FIG. 8 (D), the actuating portion 46 of the pivoting member 16 is further pivotally moved, the lower end 58 further moves from the position shown in FIG. 8 (C)

toward the connection portion 36 and the upper end 56 of the pushing portion 48 moves toward said projection 40, whereby the pushing portion 48 assumes a vertical position.

As shown in FIG. 8 (E), the lower end 58 further moves from the position shown in FIG. 8 (D) toward said connection portion 36 and the upper end 56 of said pushing portion 48 comes into contact with said projection 40.

As shown in FIG. 8 (F), when the pushing member 48 is further pivotally moved from the position shown in FIG. 8 (E), the pushing portion 48 is pivotally moved about the center (axis 54 of rotation in this stage) of the curvature of the upper end 56 toward the fitting opening 18 of said housing 12, thereby bringing the contact portion 32 of said contact 14 into contact with said connection object.

In other words, said pushing portion 48 is initially pivotally moved and then moved or displaced, and further pivotally moved, during which the axis 54 of rotation varies or moves so that the pushing portion performs its compact and space-saving pivotal movement (rotation).

Specifically, the connector 10 according to the invention has a structure which does not need an inserting force when a connecting object such as a flexible printed circuit board 70 is inserted into the fitting opening 18 (so-called "zero-insertion force (ZIF) structure), which enables said pivoting member 16 to be locked by means of a slight force by causing the pushing portions 48 of said pivoting member 16 to be pivotally moved between the projections 40, the protrusion portions 42 and the raised portions 44 of said contacts 14, and which can obtain high contact forces between the contacts and the connecting object by raising the pressure receiving portions 34 of said contacts 14 by means of the pushing portions 48 of said pivoting member 16.

Finally, mounting of the connector 10 onto the substrate 80 will be explained. In order to comply with the requirement for reduced overall height of connector in recent years, the substrate 80 is formed with the notch 82, and the connector 10 is mounted onto the substrate 80 in a manner that the connector is fitted into the notch 82 as shown in FIGS. 2 (A) and (B). With this arrangement, the total height including the connector 10 and the substrate 80 can be reduced. In other words, the total height of the connector can be reduced by the thickness of the substrate 80. If the thickness of a substrate is 0.4 mm, the total height of 1.0 mm of a connector until now can be reduced to approximately 0.6 mm. The size of the notch 82 of the substrate 80 may be suitably designed taking into account the size of the connector 10, the strength of the substrate 80, mounting position on the substrate, and the like.

FIGS. 10 to 15 illustrate another connector according to the invention (Embodiment 2).

Figure 10A:
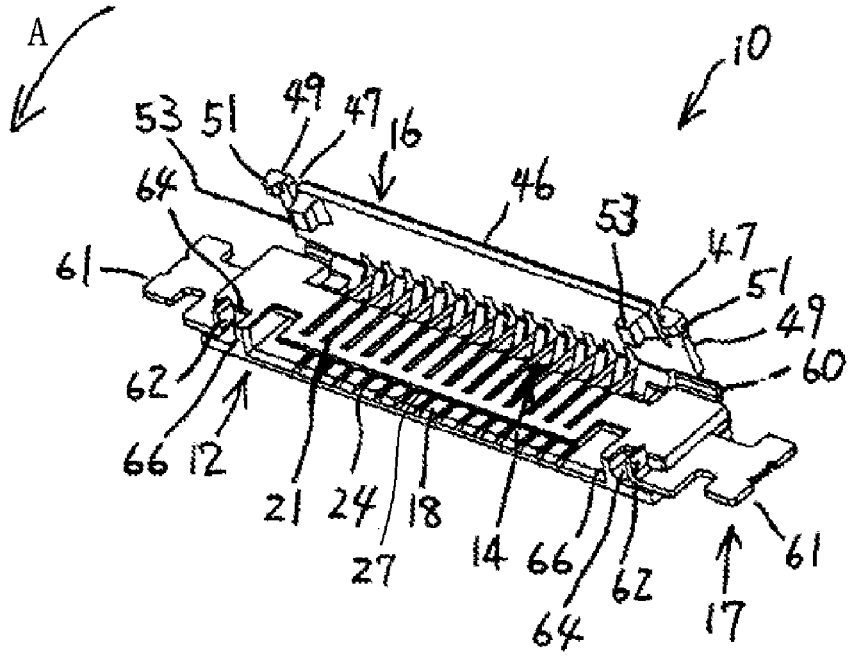
FIG. 10 (A) is a perspective view of the another connector according to the invention with the pivoting member opened, viewed from the above on the side of fitting opening.
Figure 10B:
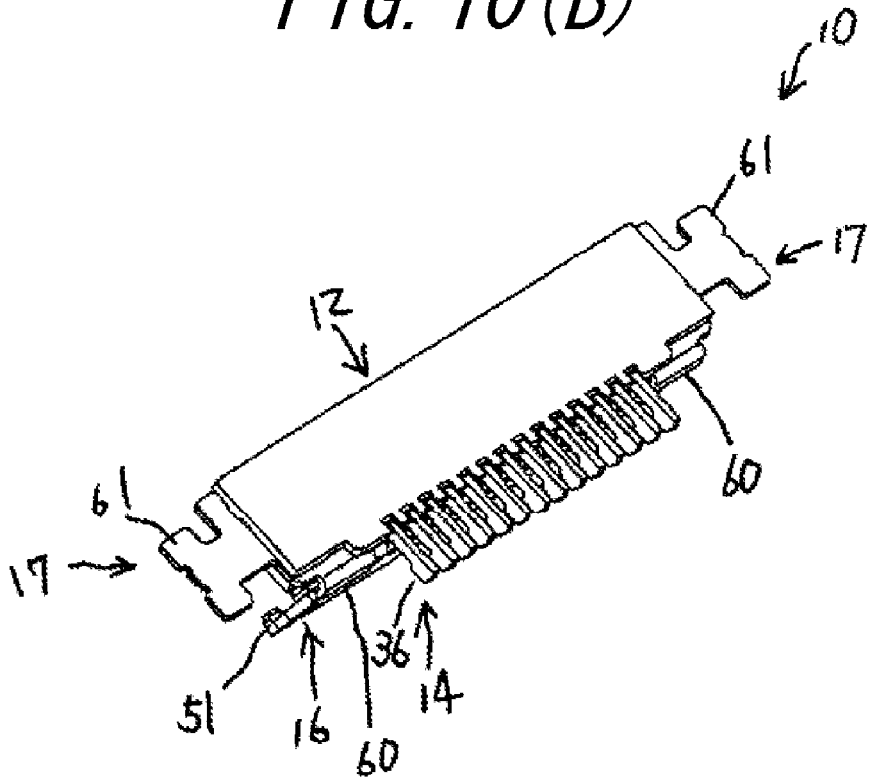
Figure 11:
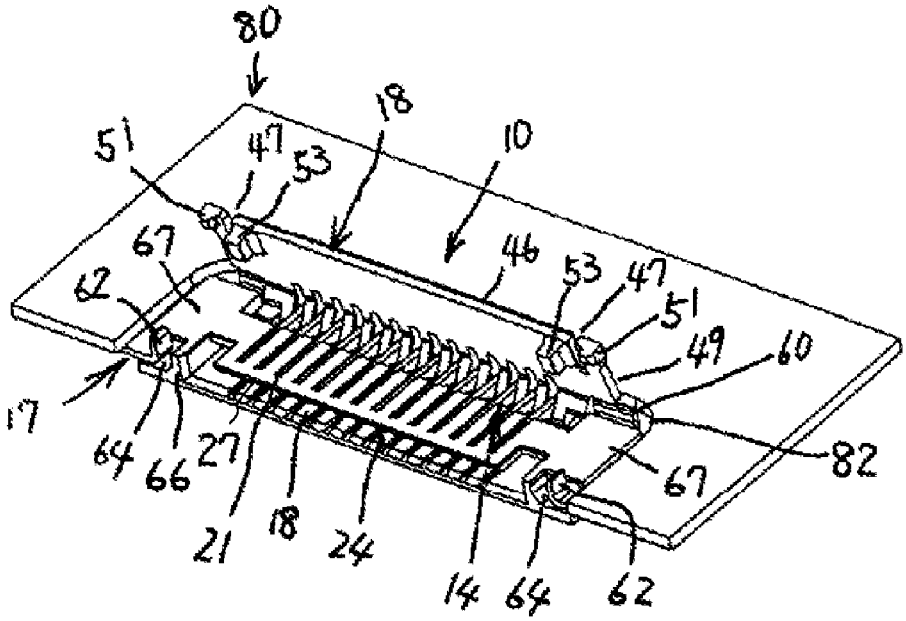
FIG. 11 (A) is a perspective view of the another connector mounted on the substrate with the pivoting member opened, viewed from the side of the fitting opening.
Figure 11:
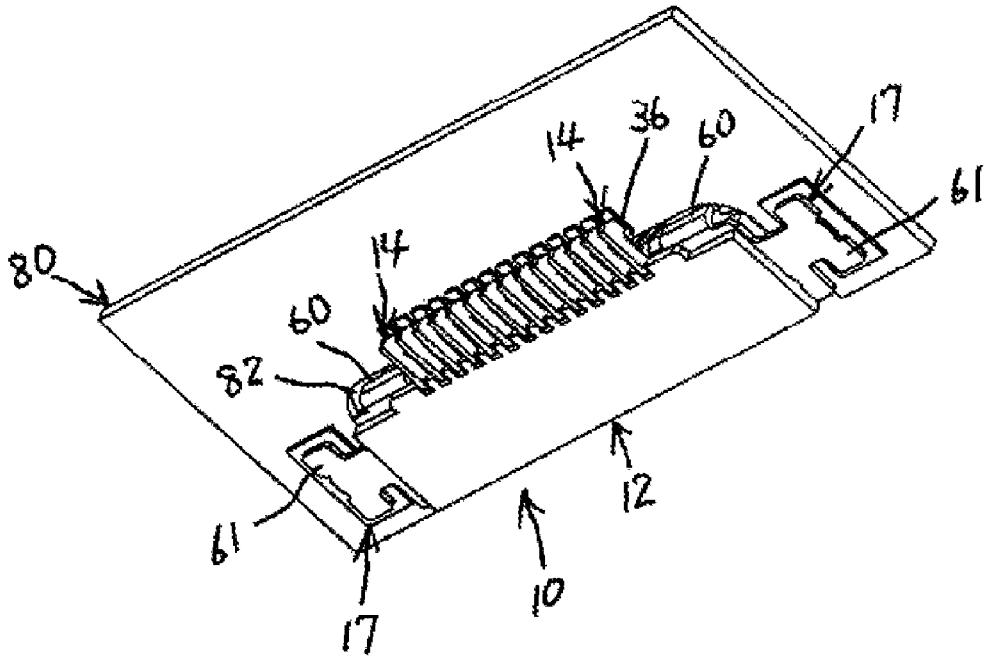
Figure 12A:
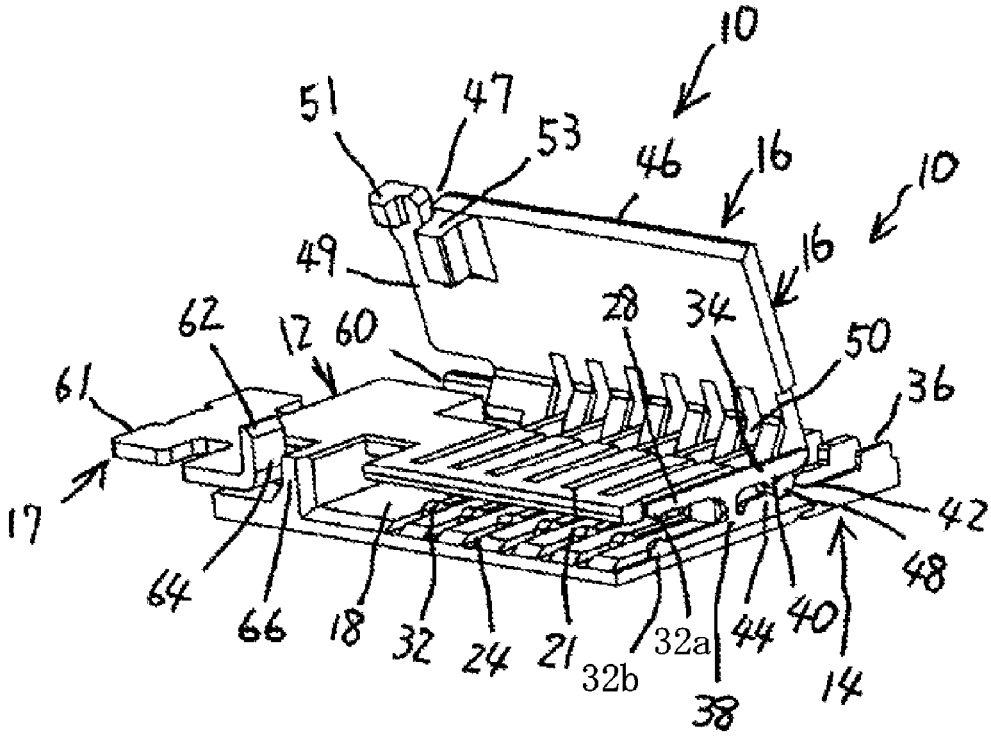
FIG. 12 (A) is a perspective view of the another connector according to the invention with the pivoting member opened, and part of the connector being cut off along one contact and removed.
Figure 12B:
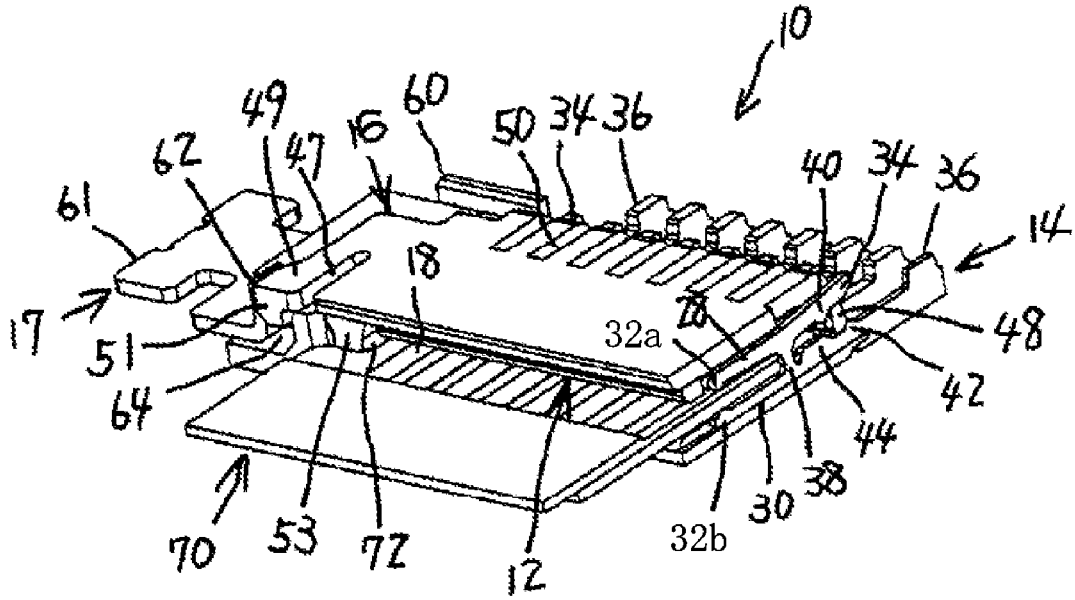
Figure 13:
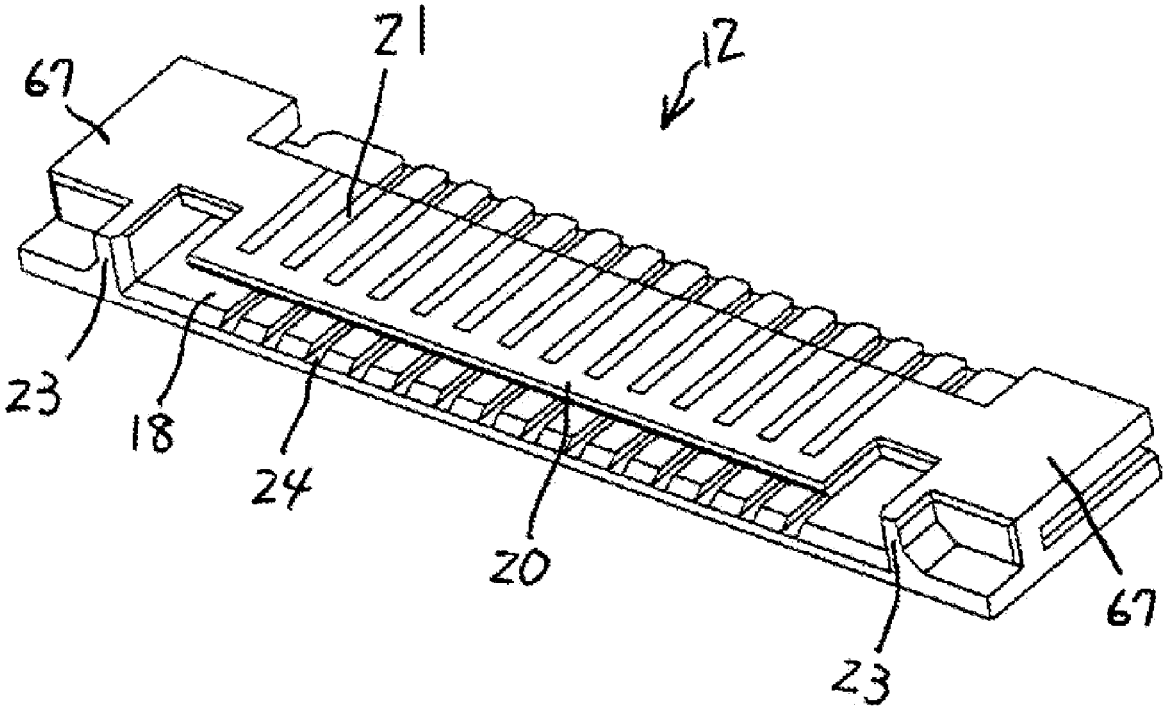
FIG. 13 is a perspective view of the housing used in the another connector.
Figure 14:
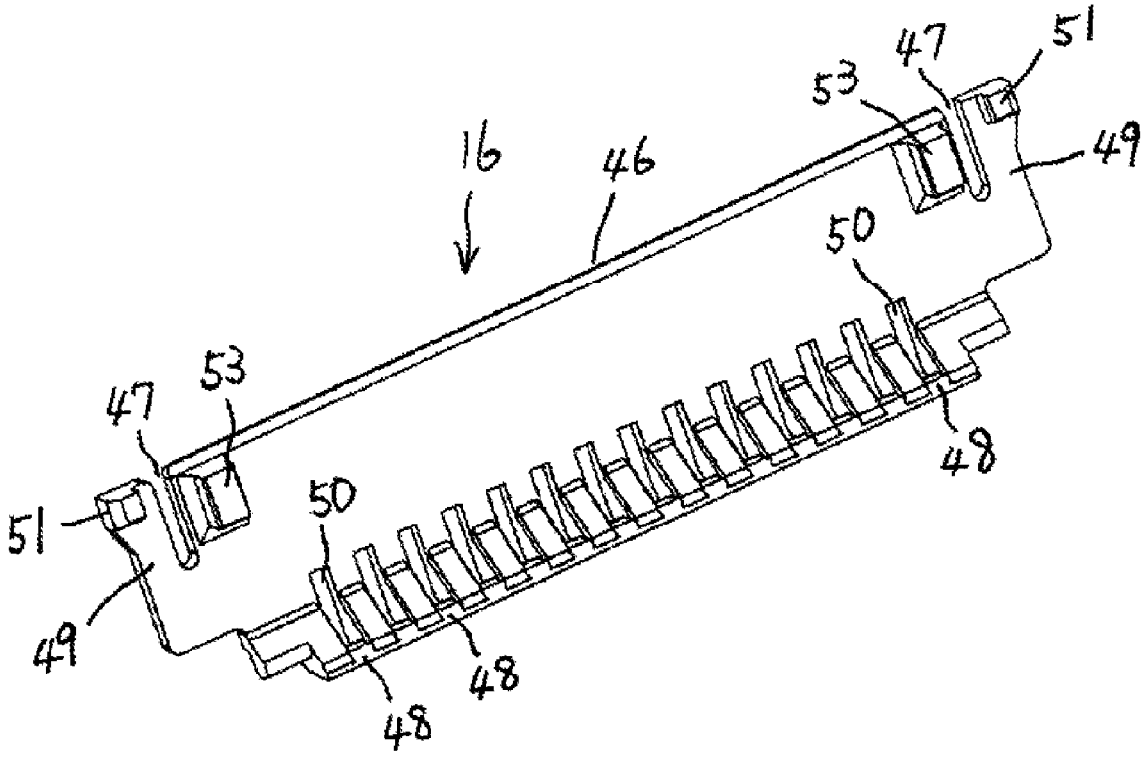
FIG. 14 is a perspective view of the pivoting member used in the another connector.
Figure 15:
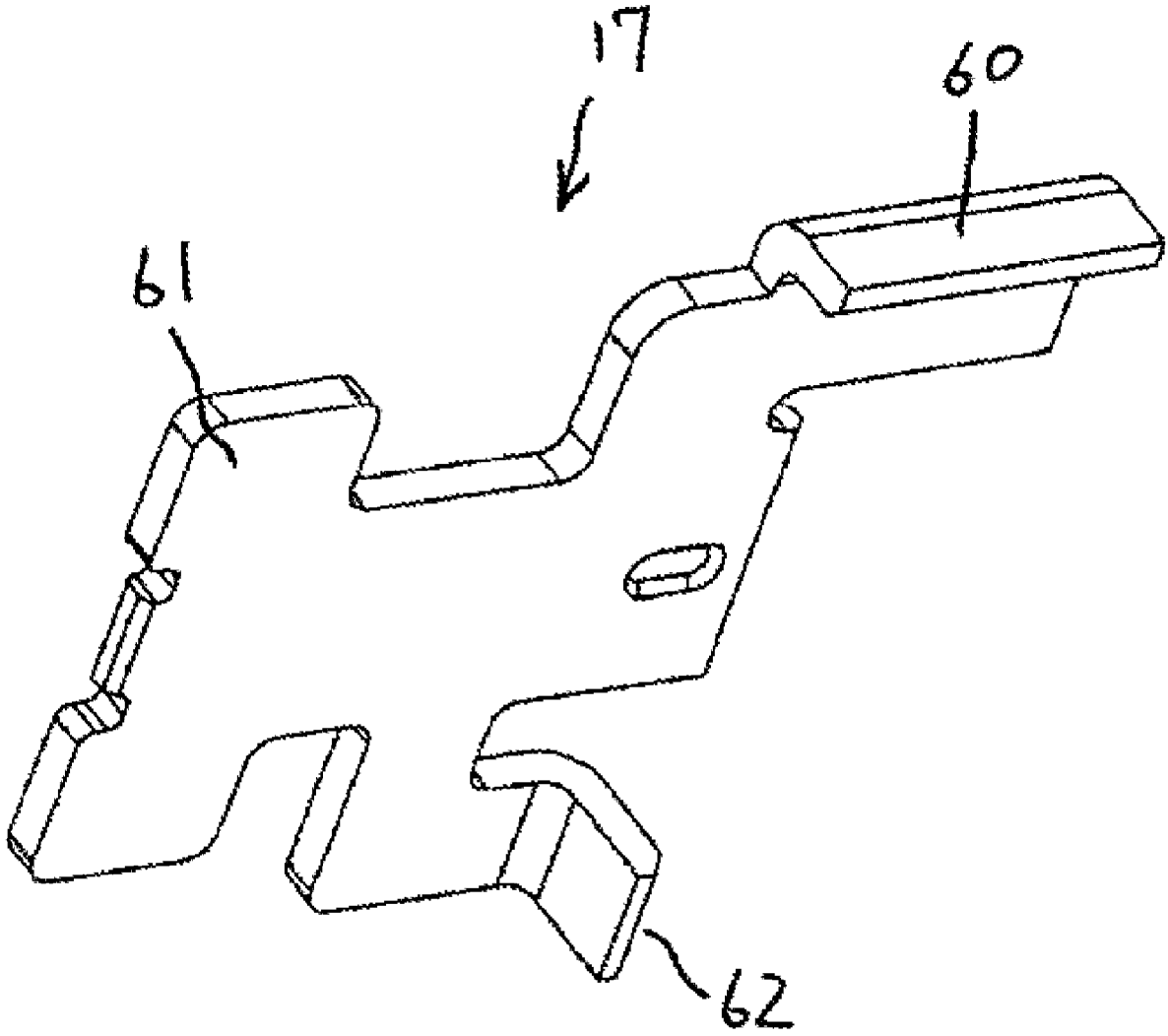
FIG. 15 is a perspective view of a fixture used in the another connector.

FIG. 10 (A) is a perspective view of the connector according to the invention with a pivoting member opened, viewed from the side of its fitting opening, and FIG. 10 (B) is a perspective view of the connector according to the invention with the pivoting member opened, viewed from the side of the connection portion. FIG. 11 (A) is a perspective view of the connector according to the invention mounted on a substrate with the pivoting member opened, viewed from the side of the fitting opening, while FIG. 11 (B) is a perspective view of the connector according to the invention mounted on the substrate with the pivoting member opened, viewed from the side of the connection portion. FIG. 12 (A) is a perspective view of the connector according to the invention with the pivoting member opened, and part of the connector being cut along one contact and removed, while FIG. 12 (B) is a perspective view of the connector according to the invention with a flexible printed circuit board inserted and the pivoting member closed, and part of the connector being cut along one contact and removed. FIG. 13 is a perspective view of the housing used in the connector shown in FIGS. 10 to 12. FIG. 14 is a perspective view of the pivoting member used in the connector shown in FIGS. 10 to 12. FIG. 15 is a perspective view of a fixture used in the connector shown in FIGS. 10 to 12.

Since the connector shown in FIGS. 10 (A) and (B) is similar in fundamental configuration to the connector of the Embodiment 1, components of the connector shown in FIGS. 10 (A) and (B) different from those of the Embodiment 1 only will be explained hereinafter.

Said pivoting member 16 is preferably provided with plate-shaped pieces 49 at both the longitudinal ends, which are partly separated from the body of the pivoting member 16 by slits 47 so as to have an elasticity, and preferably the plate-shaped pieces 49 are each provided at its tip with a protrusion 51. The protrusions 51 are each fitted in a space 64 between a side wall 66 of the housing 12 and the extended portion 62 of the fixture 17 as shown in FIG. 12 (B), thereby securely holding said pivoting member 16. The slits 47 are formed in the pivoting member 16 to support the plate-shaped pieces 49 in a cantilevered manner, thereby providing the elasticity to the plate-shaped pieces 49. The positions of said plate-shaped pieces 49 and the protrusions 51 at their tips are so designed that the protrusions 51 are fitted in the spaces 64. Moreover, the sizes of the plate-shaped pieces 49 and the protrusions 51 at their tips may be suitably designed in consideration of the function, the elasticity, the strength and the like.

As shown in FIG. 14, moreover, the pivoting member 16 is preferably provided in the proximities of both longitudinal ends with engaging projections 53 at locations corresponding to anchoring portions 72 of a connecting object such as a flexible printed circuit board 70 or flat cable so as to engage the anchoring portions 72. As shown in FIGS. 12 (A) and (B), when the pivoting member 16 is closed, said engaging projections 53 engage said anchoring portions 72, thereby positioning and holding said flexible printed circuit board 70 in an accurate position. The positions of said engaging projections 53 are suitably designed so as to correspond to said anchoring positions 72 and to enable the engaging projections 53 to engage said anchoring portions 72. The size of said engaging projections 53 need only enable the engaging projections 53 to engage the anchoring portions 72 of said connecting object, and may be suitably designed in consideration of the miniaturization of the connector 10, high-density of conductors on the substrate and the like.

The housing 12 is provided with a ceiling portion 20 which is preferably formed with a plurality of slits 21 at locations corresponding to the contacts 14. The size of the slits 21 is somewhat larger than the contacts 14, and may be suitably designed taking into the sizes of the contacts 14 and the strength and functions of the housing 12. The slits 21 accommodate the contacts 14 to achieve the reduced overall height of the connector 10.

Moreover, said housing 12 is preferably provided with extension walls 67 extending from the body of the housing 12 for fixing the fixtures 17 thereto, respectively.

The fixtures 17 are substantially plate-shaped pieces as shown in FIG. 15, which are fixed to the extension portions 67 of said housing 12 preferably by press-fitting, integral molding, welding or the like. The positions of the fixtures 17 are designed in consideration of specifications of customers, a mounting position onto a substrate 80, and the like. In the embodiment, the substrate 80 is formed with a notch 82, and the connector 10 is mounted on the substrate 80 from the side of the substrate having other parts mounted thereon so that the substrate 80 is positioned substantially at the middle of the thickness or height of the housing 12 and the pivoting member 16 is actuated on the side of the substrate 80 opposite from the other parts mounted thereon. The size of said fixtures 17 is designed taking into account the holding forces of the fixtures, occupied areas on the substrate, and the like.

Said fixtures 17 are each preferably provided with an extended portion 62 integrally with or separately from the fixture, which has an elasticity and extends in parallel with a side wall 66 of said housing 12. Said extended portion 62 is preferably formed integrally with the fixture 17 in view of the manufacturing cost. When the pivoting member 16 is closed, the protrusions 51 arranged at both the longitudinal ends of said pivoting member 16 engage said extended portions 62 arranged at both the longitudinal ends of the housing 12 as described above so that said pivoting member 16 is securely held. Further, there can be provided with a space 64 between the extended portion 62 of each of the fixtures and each of the side wall 66 of the housing so that the protrusion 51 of said pivoting member 16 engages in the space 64. The positions and size of said extended portions 62 may be suitably designed in consideration of such functions, workability, strength, and the like of the fixtures 17. Moreover, the extended portions 62 have the elasticity for the purposes of facilitating the engagement of the protrusions 51 of said pivoting member 16 and securely achieving the holding of the pivoting member 16.

Figure 16A:
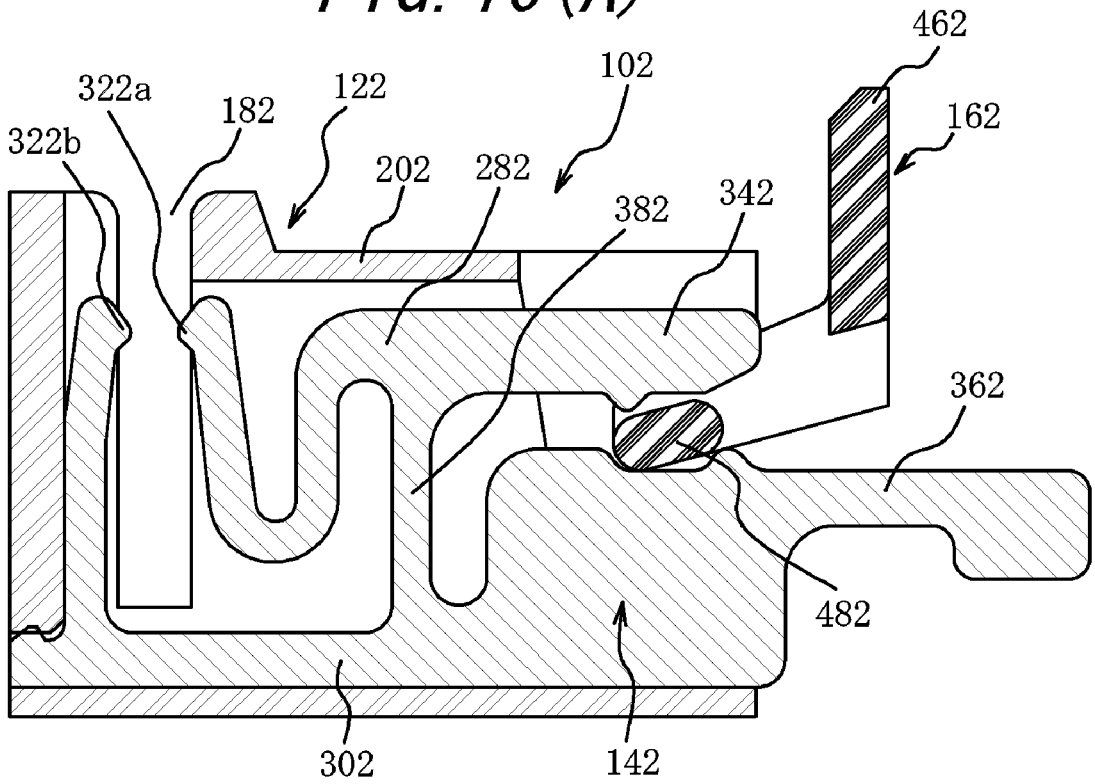
FIG. 16 (A) is a sectional view of a further connector according to the invention with a pivoting member opened, taken along one contact.
Figure 16B:
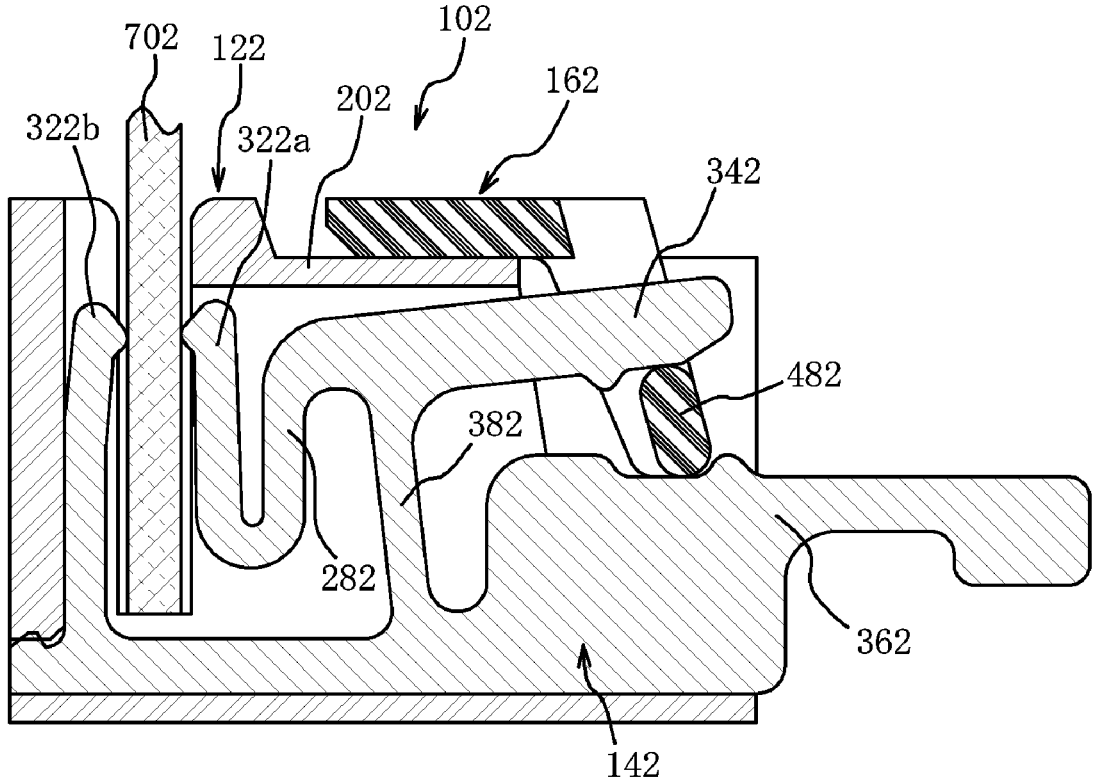

A further embodiment (Embodiment 3) of the connector 102 according to the invention will then be explained with reference to FIGS. 16 (A) and (B). FIG. 16 (A) is a sectional view of the connector according to the invention with its pivoting member opened, taken along one contact of the connector. FIG. 16 (B) is a sectional view of the connector according to the invention with a flexible printed circuit board inserted and the pivoting member closed, taken along one contact of the connector.

The contacts 142 of the connector 102 shown in FIGS. 16 (A) and (B) have a shape shown in the drawings, and the contacts each comprise a first piece 282 having at one end a contact portion 322*a* adapted to contact a connecting object and at the other end a pressure receiving portion 342 adapted to be pushed by the pivoting member 162, a second piece 302 having at one end a further contact portion 322*b* adapted to contact the connecting object and at the other end a connection portion 362 to be connected to a substrate, and a jointing portion 382 for connecting said first and second pieces 282 and 302, and further comprise holding means for permitting the pivotal movement of the pushing portion 482 of the pivoting member 162 between said pressure receiving portion 342 and said connection portion 362.

Moreover, the housing 122 comprises a fitting opening 182 at the upper section and a ceiling portion 202 covering or insulating the contact portions 322*a* of the first pieces 282 of the contacts 142.

In another embodiment of the contacts, instead of the contact portion 32*b* of the second piece as shown in FIG. 4 (A), the second piece may be provided at one end with an extension portion 35 adapted to contact a connecting object as shown in FIG. 4 (B).

Examples of applications of the invention are connectors 10 for use in electric and electronic appliances such as mobile appliances and the like, which are particularly superior in stable electrical connection with connecting object such as a flexible printed circuit board 70 or flexible flat cable and achieve a reduced overall height of the connector and minimization of dead space of a substrate, and enable the connector to be mounted onto a side of a substrate.

What is claimed is:

1. A connector to be mounted on a side of a substrate, including a plurality of contacts each having two contact portions adapted to contact a connecting object, a housing arranging and holding said contacts and having at a front section a fitting opening into which said connecting object is inserted, and a pivoting member causing said contacts to be elastically deformed so that said contacts are pushed against said connecting object, wherein said contacts each comprise a first piece having at one end the contact portion adapted to contact said connecting object and at the other end a pressure receiving portion adapted to be pushed by said pivoting member; a second piece having at one end a further contact portion adapted to contact said connecting object and at the other end a connection portion to be connected to a substrate; and a jointing portion for connecting said first and second pieces; and the contact portion of said first piece, said jointing portion, and said connection portion being arranged substantially in the form of a crank, and said contacts further comprise holding means for permitting pivotal movement of pushing portions of said pivoting member between said pressure receiving portions and said connection portions, wherein said housing comprises a ceiling portion for covering the contact portions of said contacts;

wherein said pivoting member comprises an actuating portion for pivotally moving the pivoting member; the pushing portions continuously arranged in the longitudinal direction of said pivoting member; and anchoring holes independent from one another for receiving therein said pressure receiving portions, respectively; said pivoting member being mounted on said housing so that said pushing portions are pivotally moved between said connection portions and said pressure receiving portions of said contacts, during which pivotal movement, the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object, and wherein said substrate is provided with a notch and said connector is connected to said substrate in a manner that said connector is fitted in said notch, and fixtures for fixing said housing to said substrate are arranged at both longitudinal ends of said housing, and both or either of said fixtures is provided with an extending piece integral with or separate from said fixture and extending substantially perpendicularly to said substrate on the side of the connection portions of said contacts so that a rotated angle of said pivoting member is limited by said extending piece when pivoting member is opened.

2. A connector to be mounted on a side of a substrate, including a plurality of contacts each having two contact portions adapted to contact a connecting object, a housing arranging and holding said contacts and having at an upper section a fitting opening into which said connecting object is inserted, and a pivoting member causing said contacts to be elastically deformed so that said contacts are pushed against said connecting object, wherein said contacts each comprise a first piece having at one end the contact portion adapted to contact said connecting object and at the other end a pressure receiving portion adapted to be pushed by said pivoting member; a second piece having at one end a further contact portion adapted to contact said connecting object and at the other end a connection portion to be connected to a substrate; and a jointing portion for connecting said first and second pieces; and said contacts further comprise holding means for permitting pivotal movement of pushing portions of said pivoting member between said pressure receiving portions and said connection portions, wherein said housing comprises a ceiling portion for covering the contact portions of at least either of the first and second pieces of said contacts;

wherein said pivoting member comprises an actuating portion for pivotally moving the pivoting member; the pushing portions continuously arranged in the longitudinal direction of said pivoting member; and anchoring holes independent from one another for receiving therein said pressure receiving portions, respectively; said pivoting member being mounted on said housing so that said pushing portions are pivotally moved between said connection portions and said pressure receiving portions of said contacts, during which pivotal movement, the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object, and wherein said substrate is provided with a notch and said connector is connected to said substrate in a manner that said connector is fitted in said notch, and fixtures for fixing said housing to said substrate are arranged at both longitudinal ends of said housing, and both or either of said fixtures is provided with an extending piece integral with or separate from said fixture and extending substantially perpendicularly to said substrate on the side of the connection portions of said contacts so that a rotated angle of said pivoting member is limited by said extending piece when pivoting member is opened.

3. A connector to be mounted on a side of a substrate, including a plurality of contacts each having a contact portion adapted to contact a connecting object, a housing arranging and holding said contacts and having at a front section a fitting opening into which said connecting object is inserted, and a pivoting member causing said contacts to be elastically deformed so that said contacts are pushed against said connecting object, wherein said contacts each comprise a first piece having at one end the contact portion adapted to contact said connecting object and at the other end a pressure receiving portion adapted to be pushed by said pivoting member; a second piece having at one end an extension portion extending in an opposite direction from the insertion of said connecting object and at the other end a connection portion to be connected to a substrate; and a jointing portion for connecting said first and second pieces; and the contact portion of said first piece, said jointing portion, and said connection portion being arranged substantially in the form of a crank, and said contacts further comprise holding means for permitting pivotal movement of pushing portions of said pivoting member between said pressure receiving portions and said connection portions, wherein said housing comprises a ceiling portion for covering the contact portions of said contacts;

wherein said pivoting member comprises an actuating portion for pivotally moving the pivoting member; the pushing portions continuously arranged in the longitudinal direction of said pivoting member; and anchoring holes independent from one another for receiving therein said pressure receiving portions, respectively; said pivoting member being mounted on said housing so that said pushing portions are pivotally moved between said connection portions and said pressure receiving portions of said contacts, during which pivotal movement, the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object, and wherein said substrate is provided with a notch and said connector is connected to said substrate in a manner that said connector is fitted in said notch, and fixtures for fixing said housing to said substrate are arranged at both longitudinal ends of said housing, and both or either of said fixtures is provided with an extending piece integral with or separate from said fixture and extending substantially perpendicularly to said substrate on the side of the connection portions of said contacts so that a rotated angle of said pivoting member is limited by said extending piece when pivoting member is opened.

4. A connector to be mounted on a side of a substrate, including a plurality of contacts each having a contact portion adapted to contact a connecting object, a housing arranging and holding said contacts and having at an upper section a fitting opening into which said connecting object is inserted, and a pivoting member causing said contacts to be elastically deformed so that said contacts are pushed against said connecting object, wherein said contacts each comprise a first piece having at one end the contact portion adapted to contact said connecting object and at the other end a pressure receiving portion adapted to be pushed by said pivoting member; a second piece having at one end an extension portion extending in an opposite direction from the insertion of said connecting object and at the other end a connection portion to be connected to a substrate; and a jointing portion for connecting said first and second pieces; and said contacts further comprise holding means for permitting pivotal movement of pushing portions of said pivoting member between said pressure receiving portions and said connection portions, wherein said housing comprises a ceiling portion for covering the contact portions of said contacts;

wherein said pivoting member comprises an actuating portion for pivotally moving the pivoting member; the pushing portions continuously arranged in the longitudinal direction of said pivoting member; and anchoring holes independent from one another for receiving therein said pressure receiving portions, respectively; said pivoting member being mounted on said housing so that said pushing portions are pivotally moved between said connection portions and said pressure receiving portions of said contacts, during which pivotal movement, the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object, and wherein said substrate is provided with a notch and said connector is connected to said substrate in a manner that said connector is fitted in said notch, and fixtures for fixing said housing to said substrate are arranged at both longitudinal ends of said housing, and both or either of said fixtures is provided with an extending piece integral with or separate from said fixture and extending substantially perpendicularly to said substrate on the side of the connection portions of said contacts so that a rotated angle of said pivoting member is limited by said extending piece when pivoting member is opened.

5. The connector as claimed in claims 1, 2, 3 or 4, wherein said housing is provided with slits at locations corresponding to said contacts on the side of the housing in contact with said pivoting member.

6. The connector as claimed in claims 1, 2, 3 or 4, wherein said housing is further provided at both the longitudinal ends with extension portions each having a surface to contact said substrate, and said fixtures are arranged to cover lower surfaces of said extension portions at both the longitudinal ends of the housing so that said extending pieces come into contact with the wall of said pivoting member on the side of its pivoted end, and wherein said connector is connected to said substrate so that said extension portions contact the lower surface of said substrate.

7. The connector claimed in claims 1, 2, 3 or 4, wherein said pivoting member is provided at both its longitudinal ends with plate-shaped pieces having an elasticity and partly separated from the body of the pivoting member by slits, respectively, and said plate-shaped pieces are each provided at a tip with a protrusion, and wherein said fixtures are each provided with an extended portion formed integrally with or separately from the fixture, which has an elasticity and extends substantially perpendicularly to the ceiling of said housing so that when said pivoting member is closed, the protrusions of said pivoting member engage insides of said extended portions.

8. The connector claimed in claims 1, 2, 3 or 4, wherein said pivoting member is provided at both its longitudinal ends with plate-shaped pieces having an elasticity and partly separated from the body of the pivoting member by slits, respectively, and said plate-shaped pieces are each provided at a tip with a protrusion, and wherein said fixtures are each provided with an extended portion formed integrally with or separately from the fixture, which has an elasticity and extends substantially in parallel with a side wall of said housing to form a space between said extended portion and the side wall of said housing so that when said pivoting member is closed, the protrusions of said pivoting member are fitted in said spaces, thereby securely holding said pivoting member.

9. The connector claimed in claims 1, 2, 3 or 4, wherein said connecting object is provided on both longitudinal sides with anchoring portions, and said pivoting member is provided with engaging projections at locations corresponding to and adapted to engage said anchoring portions so that when said pivoting member is closed, the engaging portions engage said anchoring portions, respectively, thereby holding said connecting object.

10. The connector as claimed in claim 6, wherein the extension portions of said housing are each provided with positioning pins for positioning the housing relative to said substrate, said positioning pins formed integrally with or separately from the extension portions on the side of the surfaces of the extension portions adapted to contact said substrate.

11. The connector as claimed in claims 1, 2, 3 or 4, wherein the connector is connected to said substrate on the side of upper surfaces of the connection portions of said contacts, and said pivoting member is actuated on the opposite side from the surface of said substrate on which said connector is mounted.

12. The connector as claimed in claims 1 or 3, wherein said housing is provided with protection walls at least at both ends of said ceiling portion for preventing said ceiling portion from being raised when said connecting object is accidentally forced upwardly.

13. The connector as claimed in claim 12, wherein said protection wall is further provided at the center of said ceiling portion or over all said ceiling portion.

14. The connector as claimed in claims 1, 2, 3 or 4, wherein said holding means comprises a projection provided on said pressure receiving portion of said first piece of at least every other contact to extend toward said connection portion, and a protrusion portion provided in the proximity of tip of the connection portion of said second piece of said at least every other contact to extend toward said pressure receiving portion.

15. The connector as claimed in claims 1, 2, 3 or 4, wherein said holding means comprises a raised portion provided between the connection portion of said second piece and said jointing portion of at least every other contact to extend toward said pressure receiving portion.

16. The connector as claimed in claims 1, 2, 3 or 4, wherein said holding means comprises a projection provided on said pressure receiving portion of said first piece of each of some contacts to extend toward said connection portion, and a protrusion portion provided in the proximity of a tip of the connection portion of said second piece of each of said some contacts to extend toward said pressure receiving portion, and said holding means further comprises a raised portion provided between the connection portion of said second piece and said jointing portion of each of the remaining contacts to extend toward said pressure receiving portion, said some contacts and said remaining contacts being alternately arranged so that said projections, said protrusion portions and said raised portions are arranged to be alternately staggered.

17. The connector as claimed in claims 1, 2, 3 or 4, wherein the pressure receiving portion of said first piece is provided at its tip with an extended portion.

18. The connector as claimed in claim 13, wherein when said connecting object is connected to said connector, the pushing portions of said pivoting member are successively positioned such that before connecting said connecting object to said connector, the lower ends of the pushing portions of said pivoting member are in contact with said raised portions, that, second, when said actuating portion is pivotally moved, the pushing portions are pivotally moved about centers of curvatures of the lower ends of the pushing portions as axes of rotation, respectively, under the condition of the lower ends in contact with said raised portions so that said pushing portions assume slightly inclined positions, that, third, when said actuating portion is further pivotally moved, the pushing portions are pivotally moved about centers of said pushing portions as axes of rotation, respectively, while the lower ends of said pushing portions are somewhat moved from the second condition toward said connection portions so that said pushing portions assume substantially vertical positions, that, fourth, when said actuating portion is further pivotally moved, said lower ends of the pushing portions are further moved from the third condition toward said connection portions and upper ends of said pushing portions are moved toward said projections so that said pushing portions assume vertical positions, that, fifth, when said actuating portion is further pivotally moved, said lower ends are further moved from the fourth condition toward said connection portions and the upper ends of said pushing portions come into contact with said projections, and that, finally, when the actuating portion of the pivoting member is further pivotally moved from the fifth condition, said pushing portions are pivotally moved about centers of curvatures of said upper ends as axes of rotation, respectively, whereby the contact portions of said contacts are brought into contact with said connecting object by pivotally moving said pivoting member toward the fitting opening of said housing.

* * * * *